US009909314B2

(12) United States Patent
Jobin et al.

(10) Patent No.: US 9,909,314 B2
(45) Date of Patent: Mar. 6, 2018

(54) FOLDABLE STRUCTURAL TRUSS

(71) Applicant: LES ENCEINTES ACOUSTIQUES UNISSON INC., Saint-Roch-de-l'Achigan (CA)

(72) Inventors: Pierre Jobin, Laval (CA); Jean-Francois Ducharme, Montreal (CA); Johnny Bouchard, Rosemere (CA)

(73) Assignee: LES ENCEINTES ACOUSTIQUES UNISSON INC., Saint-Roch-de-l'Achigan, Quebec (CA)

( * ) Notice: Subject to any disclaimer, the term of this patent is extended or adjusted under 35 U.S.C. 154(b) by 0 days.

(21) Appl. No.: 14/947,769

(22) Filed: Nov. 20, 2015

(65) Prior Publication Data

US 2016/0090741 A1 Mar. 31, 2016

Related U.S. Application Data

(63) Continuation of application No. PCT/CA2014/050487, filed on May 23, 2014.
(Continued)

(51) Int. Cl.
*E04C 3/02* (2006.01)
*E04C 3/04* (2006.01)
(Continued)

(52) U.S. Cl.
CPC ..... *E04C 3/04* (2013.01); *E04B 1/34326* (2013.01); *E04C 3/005* (2013.01); *E04C 3/08* (2013.01);
(Continued)

(58) Field of Classification Search
CPC ..... E04C 3/04; E04C 3/005; E04B 1/3441; E04B 1/34357; B66C 23/68
See application file for complete search history.

(56) References Cited

U.S. PATENT DOCUMENTS 1,141,385 A 6/1915 Ellinger
1,176,994 A 3/1916 Spelling
(Continued)

FOREIGN PATENT DOCUMENTS

EP 0733584 A1 9/1996
EP 1079039 A1 2/2001
(Continued)

OTHER PUBLICATIONS

Machine translation in English of EP-0733584 A1.
(Continued)

*Primary Examiner* — Christine T Cajilig
(74) *Attorney, Agent, or Firm* — Ipaxio S.E.NC.

(57) ABSTRACT

The elongated double-fold foldable structural truss has a quadrilateral framework extending along a longitudinal direction. It includes four chord beam units disposed parallel to one another. Each chord beam unit includes two spaced-apart and juxtaposed beams running parallel to one another. The beams define between them a first open channel that is opened on one of the inner sides of the chord beam unit. The structural truss further includes four web units having brace members. The brace members of at least two of the web units are telescopic. The telescopic brace members are all in their extended position when the structural truss is in its unfolded position and being all in their retracted position when the structural truss is in its folded position. The foldable structural truss is very compact in its folded position.

18 Claims, 25 Drawing Sheets

Related U.S. Application Data

(60) Provisional application No. 61/826,976, filed on May 23, 2013.

(51) Int. Cl.
*E04C 3/00* (2006.01)
*E04C 3/08* (2006.01)
*E04B 1/343* (2006.01)

(52) U.S. Cl.
CPC ..... *E04C 2003/0417* (2013.01); *E04C 2003/0495* (2013.01)

(56) References Cited

U.S. PATENT DOCUMENTS 2,744,590 A * 5/1956 Butts ..... E04B 5/14 52/645
2,875,935 A * 3/1959 Buttermore ..... E06C 1/383 182/160
2,982,379 A 5/1961 Fisher
3,011,586 A 12/1961 Harvey, Jr.
3,235,038 A 2/1966 Nesslinger
3,722,622 A * 3/1973 Lauring ..... E06C 1/383 182/159
3,760,550 A 9/1973 Mueller et al.
3,783,573 A 1/1974 Vaughan
4,017,932 A 4/1977 Lotto et al.
4,475,323 A 10/1984 Schwartzberg et al.
4,482,900 A 11/1984 Bilek et al.
4,546,591 A * 10/1985 Beltz ..... E04H 12/10 52/645
4,667,451 A 5/1987 Onoda
4,677,803 A 7/1987 Mikulas, Jr. et al.
5,016,418 A 5/1991 Rhodes et al.
5,040,349 A 8/1991 Onoda et al.
5,125,206 A 6/1992 Motohashi et al.
5,251,412 A * 10/1993 de Almeida Borges .. E04B 7/00 52/109
5,765,248 A 6/1998 Ono
5,819,492 A 10/1998 Konicek
5,826,397 A 10/1998 Armold
6,055,999 A * 5/2000 Grey ..... E04H 15/322 135/143
6,161,359 A 12/2000 Ono
6,634,152 B1 10/2003 Pilkinton
6,986,230 B2 1/2006 Schipani et al.
7,357,238 B2 4/2008 Zeigler
7,469,513 B2 12/2008 Schipani et al.
7,703,615 B2 4/2010 Willim
7,716,897 B2 5/2010 Merrifield
7,779,598 B2 8/2010 Daas et al.
8,028,488 B2 10/2011 Dodd
8,272,337 B2 9/2012 Carter
8,333,209 B2 12/2012 Daas et al.
8,707,653 B2 4/2014 Calleja
8,851,096 B2 * 10/2014 De Villenfagne De Sorinnes ..... E04C 3/005 135/122
8,978,338 B2 3/2015 Jobin et al.
9,027,711 B2 * 5/2015 Lonergan ..... E06C 7/50 182/163
9,062,448 B2 * 6/2015 Richardson ..... E04B 1/1903
2010/0326004 A1 12/2010 Daas et al.
2011/0114417 A1 5/2011 Daas et al.
2011/0185674 A1 8/2011 Daas et al.
2011/0258960 A1 10/2011 Daas et al.
2011/0308189 A1 12/2011 Daas et al.
2012/0110946 A1 5/2012 Daas et al.
2013/0168522 A1 7/2013 Daas et al.

FOREIGN PATENT DOCUMENTS

EP 1293619 A1 3/2003
GB 786884 A * 11/1957 ..... E04B 1/3441
RU 2136549 C1 9/1999
RU 2137684 C1 9/1999
WO 9840579 A1 9/1998
WO 2012094766 A1 7/2012
WO 2012098080 A2 7/2012
WO 2014186906 A1 11/2014

OTHER PUBLICATIONS

Machine translation in English of EP-1079039 A1.
Machine translation in English of RU-2136549 C1.
Machine translation in English of RU-2137684 C1.
Machine translation in English of WO-98/40579 A1.
International Preliminary Report on Patentability (IPRP) under Chapter I of PCT/CA2014/050487 (report dated Dec. 3, 2015).

* cited by examiner

FOLDABLE STRUCTURAL TRUSS

CROSS REFERENCE TO PRIOR APPLICATIONS

The present case is a continuation of PCT Application No. PCT/CA2014/050487 filed on 23 May 2014. PCT/CA2014/050487 claims the benefit of U.S. patent application No. 61/826,976 filed on 23 May 2013. The entire contents of these previous patent applications are hereby incorporated by reference.

TECHNICAL FIELD

The technical field relates generally to foldable structural trusses.

BACKGROUND

Structural trusses are used in a wide variety of situations and constructions. They can be used horizontally, vertically or in any other orientation. They include a plurality of rigid frame members interconnected to one another so as to create a skeletal open structure.

Some structural trusses are used in situations where they will be often moved from one location to another. An example of situation is when they are used in performance stages. Many performance stages are designed to be transported from site to site, for example when they are used as concert tour stages. They are thus assembled and disassembled frequently.

Each time a temporary construction must be assembled at a given site, it requires parts to be transported at the site, for instance using one or more truck trailers or the like. This often includes transporting large parts such as structural trusses. Since the space available on a truck trailer is inevitably limited and minimizing the total number of truck trailers is always desirable, minimizing the overall space of each part, especially the largest ones, can have a huge impact on the transportation costs.

Some structural trusses are made of a plurality of parts that are welded or otherwise permanently attached together. They cannot be folded or be completely disassembled into smaller parts. They are thus relatively large in size and they require a lot of space. Structural trusses made of a plurality of detachable parts can be stored and transported in considerably smaller spaces. However, they require that all the parts to be assembled before use and disassembled afterwards. This increases the assembly time and the labor costs.

Foldable structural truss arrangements have been suggested in the past. These arrangements often have parts hinged and/or otherwise operatively connected together to create a self forming assembly that can be collapsed to save space during storage and transportation, and deployed thereafter before use. Examples can be seen in U.S. Pat. No. 3,235,038 (Nesslinger) of 1966, U.S. Pat. No. 5,016,418 (Rhodes et al.) of 1991, U.S. Pat. No. 5,040,349 (Onoda et al.) of 1991, U.S. Pat. No. 7,716,897 (Merrifield) of 2010, U.S. Pat. No. 8,028,488 (Doff) of 2011, and US-2012/0110946 (Daas et al.) of 2012. However, the arrangements disclosed in these references are not always well adapted for use in a wide range of environments and purposes. Some of them also require complex constructions and can be difficult to implement. Still, while reducing the size of some structural truss arrangements when they are in their folded position would be highly desirable, this can be very challenging to achieve, if not impossible, using existing approaches, especially if this must be done without reducing the supported load and without significantly impairing one or more additional design factors, for instance weight, manufacturing costs, assembly time on a site and the associated labor costs, to name just a few.

Clearly, room for improvements still exists in this technical area.

SUMMARY

In one aspect, there is provided an elongated double-fold foldable structural truss having a quadrilateral framework extending along a longitudinal direction, the structural truss being movable between a folded position and an unfolded position, and including: four chord beam units disposed parallel to one another, each chord beam unit being located at a corresponding corner of the quadrilateral framework and having four sides, two of the sides being inner sides and two of the sides being outer sides, each inner side facing a corresponding one of the inner sides of another one of the chord beam units of the structural truss, each chord beam unit including: two spaced-apart and juxtaposed beams running parallel to one another, the beams defining between them a first open channel extending substantially along an entire length of the structural truss, the first open channel being opened on one of the inner sides of the chord beam unit, the chord beam unit having a second open channel on the other one the inner sides of the chord beam unit, the second open channel extending substantially along the entire length of the structural truss; a plurality of first pivot joints extending transversally in-between the two spaced-apart beams and across the first open channel, the first pivot joints having first pivot axes that are parallel to one another and that are perpendicular to the longitudinal direction; and a plurality of second pivot joints extending perpendicularly across the second open channel, the second pivot joints having second pivot axes that are parallel to one another, that are perpendicular to the longitudinal direction and that are perpendicular to the first pivot axes of the chord beam unit; and four web units, each including a plurality of brace members interconnecting two corresponding ones of the chord beam units (110), the brace members of two of the web units having opposite ends that are pivotally connected to corresponding ones of the first pivot joints and the braces members of two of the web units having opposite ends that are pivotally connected to corresponding ones of the second pivot joints, the brace members of at least two of the web units being telescopic, each telescopic brace member including two sections in telescopic engagement with one another and being movable between a retracted position and an extended position, the telescopic brace members being all in their extended position when the structural truss is in its unfolded position and being all in their retracted position when the structural truss is in its folded position, all brace members extending at least partially inside a corresponding one of the open channels when the structural truss is in its folded position.

In another aspect, there is provided a structural truss as shown, described and/or suggested herein.

In another aspect, there is provided a structural truss system as shown, described and/or suggested herein.

In another aspect, there is provided a method of folding and unfolding a structural truss as shown, described and/or suggested herein.

Further details on the various aspects of the proposed concept will be apparent from the following detailed description and the appended figures.

DETAILED DESCRIPTION

Figure 1:
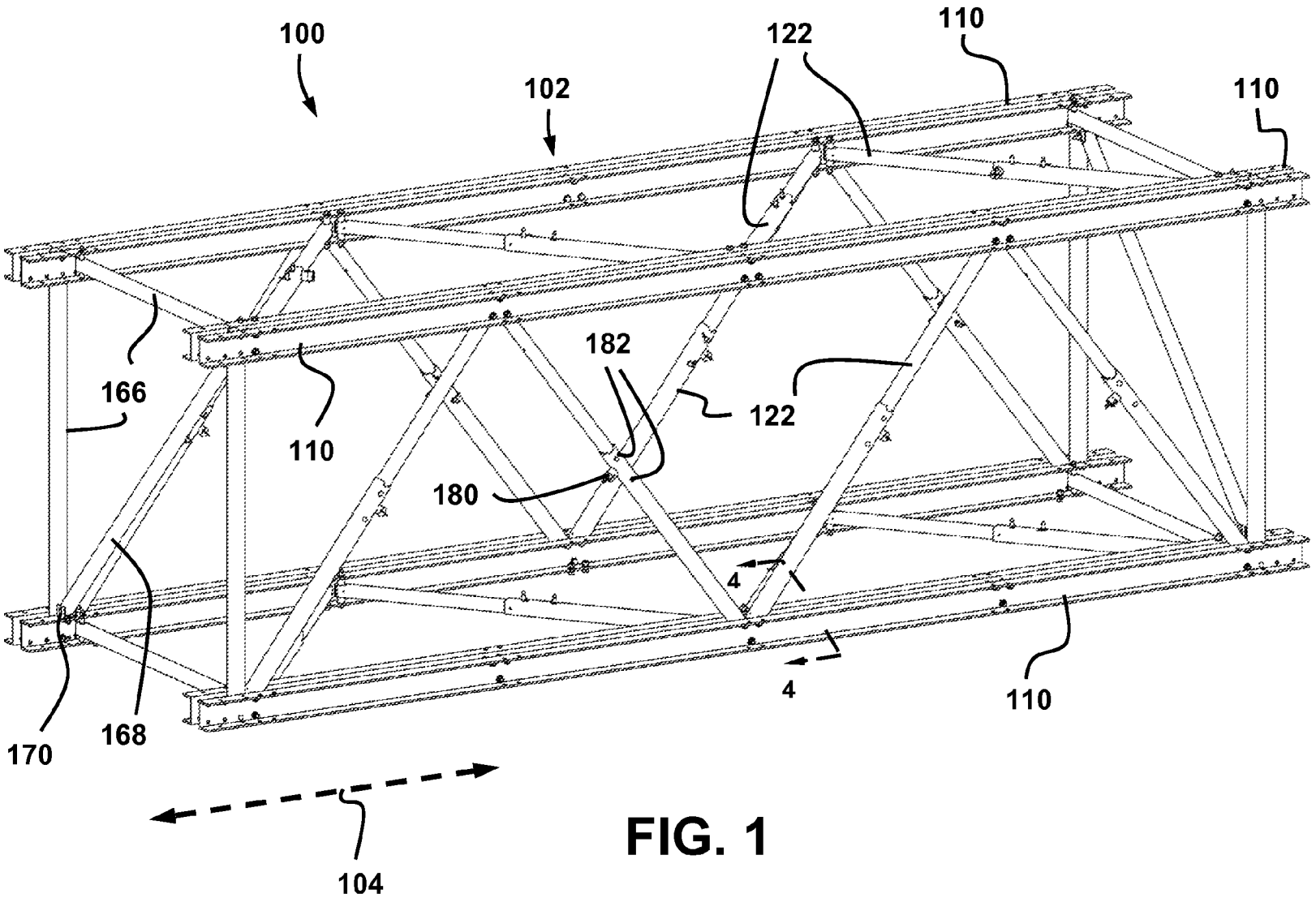
FIG. 1 is an isometric view of an example of an elongated double-fold foldable structural truss incorporating the proposed concept, the structural truss being shown in its unfolded position.
Figure 2:
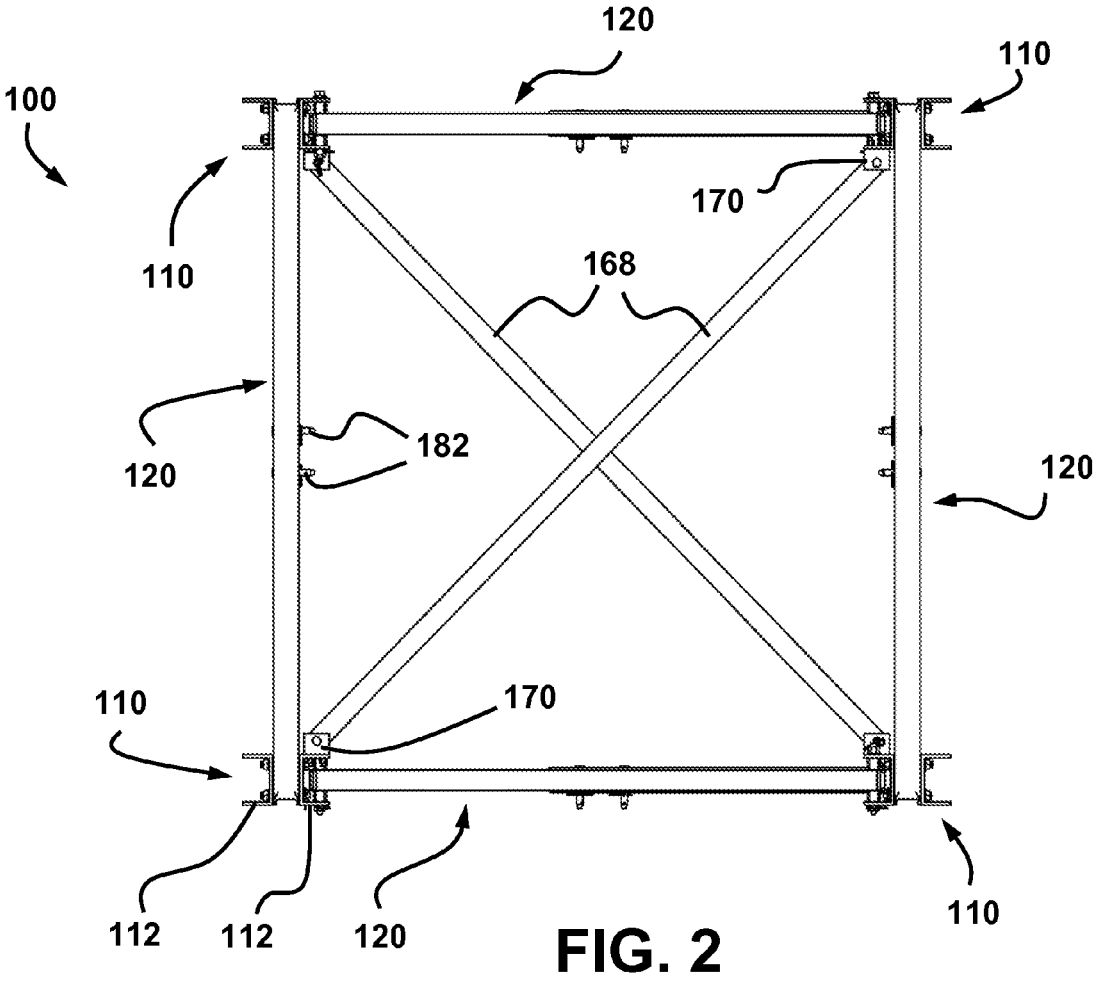
FIG. 2 is an end view of the structural truss shown in FIG. 1.

FIG. 1 is an isometric view of an example of an elongated double-fold foldable structural truss 100 incorporating the proposed concept. FIG. 2 is an end view of this structural truss 100. The structural truss 100 is selectively movable between a folded compact position and an unfolded working position. The structural truss 100 is shown in its unfolded position in FIGS. 1 and 2, thus in the position where it can be used in or as a framework. The unfolded structural truss 100 can be used horizontally, vertically or obliquely. More than one structural truss 100 can be juxtaposed end-to-end and rigidly connected to one another so as to form a longer framework structure.

The structural truss 100 can be folded and unfolded repeatedly in two perpendicular directions. The folded position is for storage and transportation. It is thus very convenient for use in knockdown structures that must be transported, assembled and then disassembled at frequent occasions.

The parts of the structural truss 100 are made of a rigid material, for instance metallic material such as aluminum or an alloy thereof. Nevertheless, other materials are possible as well.

The structural truss 100 has a quadrilateral framework 102 extending along a longitudinal direction 104. It includes four chord beam units 110 disposed parallel to one another and extending along the entire length of the structural truss 100 when it is in its unfolded position. Each chord beam unit 110 is located on a corresponding corner of the quadrilateral framework 102. Each chord beam unit 110 has two inner sides and two outer sides. Each inner side faces a corresponding one of the inner side of another one of the chord beam units 110. Each of the outer sides are opposite one of the inner sides. Thus, the two inner sides are perpendicular with reference to one another. The four chord beam units 110 are identically in the illustrated example. Variants are possible as well.

Figure 3:
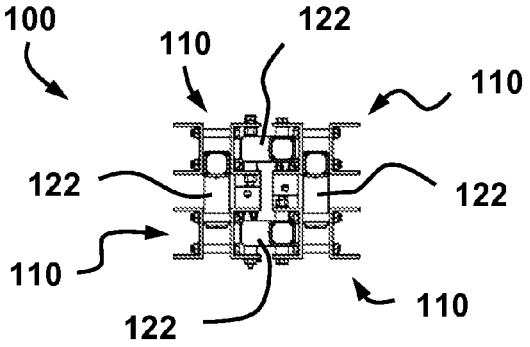
FIG. 3 is an end view of the structural truss of FIG. 1 but shown in its completely folded position.

The structural truss 100 is designed to be very compact in the folded position, as shown for instance in FIG. 3. FIG. 3 is an end view of the structural truss 100 of FIG. 1 but it is shown in its completely folded position. Once folded, the chord beam units 110 are brought very closely together and the distance between their mutually-facing inner sides is greatly minimized. The scale in FIGS. 2 and 3 is the same. As can be seen, the overall cross section area was reduced almost 20 times in this example between the unfolded position and the folded position.

Figure 4:
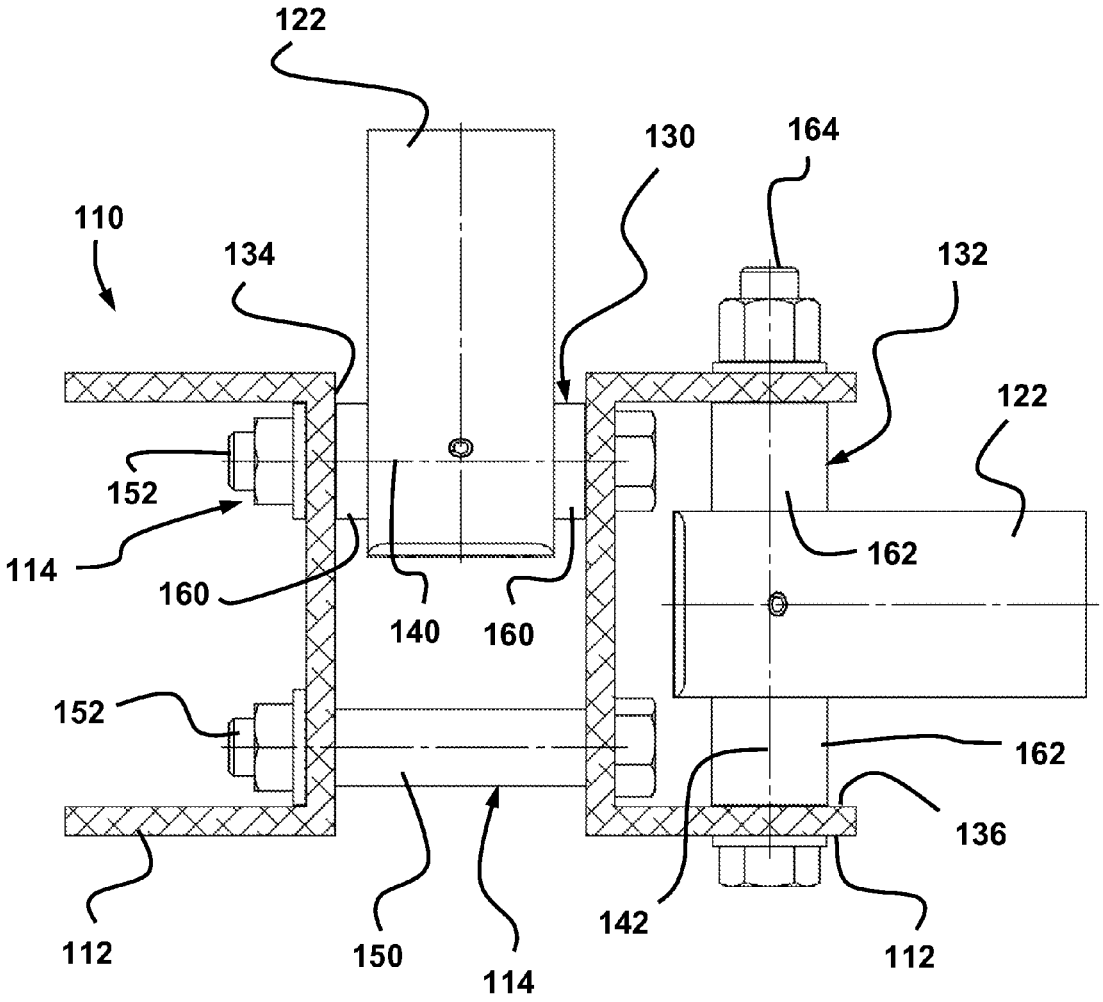
FIG. 4 is a cross-sectional view taken along line 4-4 in FIG. 1.

Each chord beam unit 110 in the illustrated example includes two spaced-apart and oppositely-juxtaposed C-shaped beams 112 running parallel to one another. The two beams 112 of each chord beam unit 110 extend along the entire length of the structural truss 100. The back sides of these two beams 112 are rigidly interconnected using a plurality of longitudinally-spaced sets of beam holders 114, as best shown in FIG. 4. Variants are possible as well. For instance, the two beams 112 can be different from one another instead of being identical (mirror image) of one another. They can have a cross section other than a C-shaped cross section, particularly in the case of the beam 112 that will be positioned on the exterior lateral side of the structural truss 100.

FIG. 4 is a cross-sectional view taken along line 4-4 in FIG. 1.

Four web units 120 are provided on the structural truss 100. Each web unit 120 includes a plurality of brace members 122 interconnecting two corresponding ones of the chord beam units 110. The brace members 122 are obliquely disposed with reference to the longitudinal direction 104 of the structural truss 100. Variants are possible as well.

At least two of the web units 120 include brace members 122 that are telescopic. Each telescopic brace member 122 includes two sections in telescopic engagement with one another. One section is large in size and the other fits therein. These sections are movable between a retracted position and an extended position. The telescopic brace members 122 are all in their extended position when the structural truss 100 is in its unfolded position and are all in their retracted position when the structural truss 100 is in its folded position. When only two of the web units 120 include telescopic brace members 122 and the other two web units 120 have non-telescopic brace members 122, the web units 120 with the telescopic brace members 122 are both extending parallel to one another while the web units 120 with the non-telescopic brace members 122 are both extending parallel to one another. In the example illustrated in FIG. 1, all four web units 120 have telescopic brace members 122. The brace members 122 can have a circular cross section but other shapes and arrangements are possible as well. Still, other variants are also possible.

The brace members 122 of two of the web units 120 have opposite ends that are pivotally connected to first pivot joints 130. The brace members 122 of the other two of the web units 120 have opposite ends that are pivotally connected to second pivot joints 132. An example of a first pivot joint 130 and of a second pivot joint 132 are shown in FIG. 4. The first pivot joints 130 have first pivot axes 140 that are parallel to one another and that are perpendicular to the longitudinal direction 104. The second pivot joints 132 have second pivot axes 142 that are parallel to one another and that are also perpendicular to the longitudinal direction 104. These second pivot joints 132 extend perpendicularly across one of the inner sides of the beams 112. The first pivot axes 140 and the second pivot axes 142 are perpendicular to one another.

As can be seen in FIG. 4, the intervening space in-between the two beams 112 of each chord beam unit 110 forms a first open channel 134 extending along the entire length of the structural truss 100 on one of the inner sides of the chord beam unit 110. In the illustrated example, the intervening space also reaches the outer side. Variants are possible.

The other inner side of each chord beam unit 110 has a second open channel 136 extending along the entire length of the structural truss 100. In the illustrated example, the second open channel 136 is created by the opposite flanges of the C-shaped beam 112. Both open channels 134, 136 are made larger than the width (or outer diameter) of the corresponding brace members 122. Variants are possible. In use, the ends of the brace members 122 remain connected to the corresponding pivot axes 130, 132 and the brace members 122 extend at least partially inside the corresponding open channels 134, 136 when the structural truss 100 is in its folded position. This maximizes the compactness of the folded structural truss 100.

As aforesaid, FIG. 4 shows some of the beam holders 114. In the illustrated example, one of the beam holders 114 includes a rigid cylindrical spacer 150 extending between the mutually-facing inner faces of the two beams 112. A bolt 152 is coaxially inserted through the cylindrical spacer 150 and also through registered holes made across the beams 112. A nut and washer are provided at the end of the bolt 152 and the assembly is tightened to firmly hold the parts together. The heads of the bolts 152 as well as the corresponding nuts and washers are all located inside the beams 112. The beam holders 114 are grouped in sets of three in the illustrated example, where one of the three beams holders 114 is offset with reference to the others. The nuts of many of the beam holders 114 are visible in FIG. 1. Variants are possible.

Furthermore, in the illustrated example, the first pivot joint 130 is also used as a spacer. The first pivot joint 130 includes a pair of annular bushings 160 coaxially disposed with reference to the first pivot axis 140. A corresponding bolt 152 is inserted through a through-hole at the end of the corresponding brace members 122 and also through registered holes made across the beams 112. A nut and washer are also provided at the end of this bolt 152 and the assembly is tightened to firmly hold the parts together. The bushings 160 can be made of a material such as nylon or any other suitable material. They allow pivoting the corresponding brace members 122 even if the bolt 152 is tighten. Other configurations and arrangements are possible as well.

The second pivot joint 132 also includes a pair of annular bushings 162 and the arrangement is similar to that of the first pivot joint 130 in the illustrated example. It uses a bolt 164. Variants are possible as well.

The quadrilateral framework 102 forms the basic components of the structural truss 100. However, in the example illustrated in FIGS. 1 and 2, each end of the structural truss 100 also includes other brace parts to further rigidify the framework 102. This may be useful or required in some implementations but not necessarily in others. Also, some external components to which the structural truss 100 will be directly connected to can provide similar functions.

As can be seen in FIGS. 1 and 2, the illustrated structural truss 100 includes a set of four additional brace members 166 extending at right angle between corresponding ones of the chord beam units 110, and a cross brace member 168 extending diagonally across two diametrically-opposite chord beam units 110. Two diametrically-opposite chord beam units 110 are interconnected by the cross brace member 168 at one end and the other two diametrically-opposite chord beam units 110 are interconnected by the other cross brace member 168 at the opposite end of the structural truss 100. Both cross brace members 168 are not parallel to one another in the example. Variants are possible as well.

Still, in the illustrated example, the ends of these cross brace members 168 are removably connected to the corresponding chord beam units 110 using brackets 170. The additional brace members 166 provided at right angles are connected to the chord beam units 110 inside a corresponding one of the open channels 134, 136. All these additional brace members 166 and cross brace members 168 can be completely removed from the structural truss 100 before it is folded. Other arrangements and configurations are also possible.

In the illustrated example, the telescopic brace members 122 each include a self-locking mechanism that automatically locks itself when the two sections of the corresponding brace member 122 reach the extended position. This facilitates the unfolding of the structural truss 100. Workers simply have to move the chord beam units 110 away from one another until the self-locking mechanisms of the brace members 122 are locked. The self-locking mechanisms can include, for instance, spring-biased buttons 180 extending radially out of a hole from the corresponding telescopic brace members 122 when the right position is reached. These buttons 180 can be manually depressed by the workers. Other configurations and arrangements are also possible.

Since the buttons 180 of the self-locking mechanisms have a relatively limited shear resistance, the corresponding sections of each telescopic bracing member 122 can be secured by one or more removable fasteners, for instance bolts, pins or the like. These fasteners are positioned substantially radially across corresponding aligned openings provided through the sections. These openings are configured and disposed to be registered when the self-locking mechanisms are in their locked position. The fasteners 182 are inserted and removed by the workers. Variants are possible as well.

To unfold the structural truss 100, the fasteners 182 must all be removed from the brace members 122 and the buttons 180 can be depressed by hand on each of the brace members 122 to release the self-locking mechanisms and be able to move the telescopic brace members 122 in their retracted position. Variants are possible as well.

It should be noted that the structural truss 100 can be designed to have with more than one unfolded position. One can include one or more additional possible positions where there is less than the maximum width of the structural truss 100 in one or even the two directions, for instance to fit in a small space. Accordingly, any possible working position of the structural truss 100 where it can be locked and secured for use in or as a framework structure is a position where the structural truss 100 can be considered as being completely unfolded. Variants are possible as well.

Figure 5:
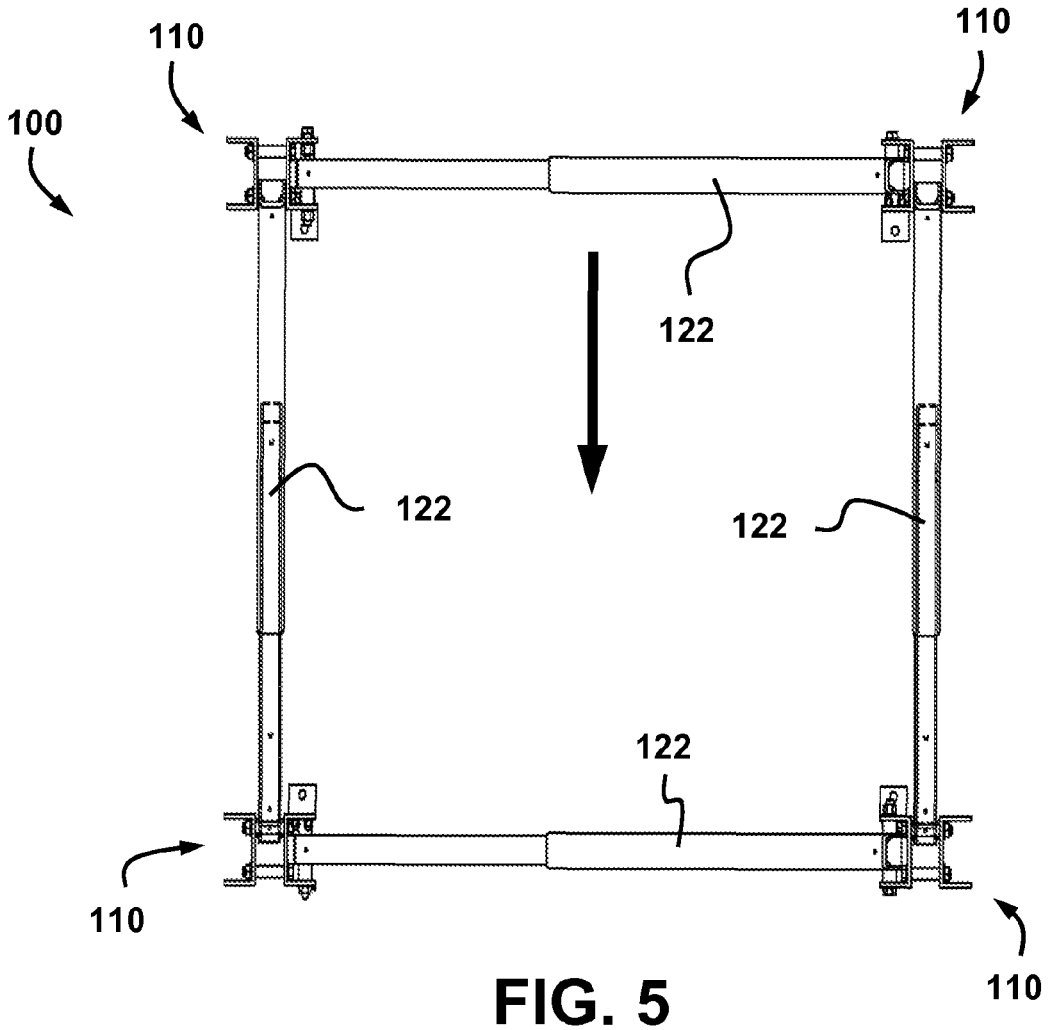
FIG. 5 is an end view similar to FIG. 2 but showing the structural truss of FIG. 1 being folded.
Figure 6:
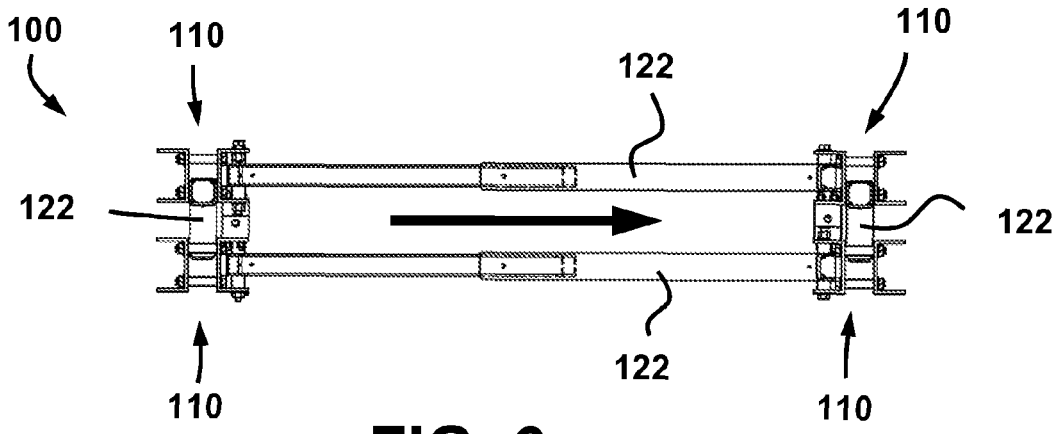
FIG. 6 illustrates the structural truss of FIG. 5 after being partially folded and while being folded in the other direction.

FIG. 5 is an end view similar to FIG. 2 but showing the structural truss 100 of FIG. 1 being folded in the direction depicted by the arrow. FIG. 6 illustrates the structural truss 100 of FIG. 5 after being partially folded and while being folded in the other direction, as depicted by the arrow.

Figure 7:
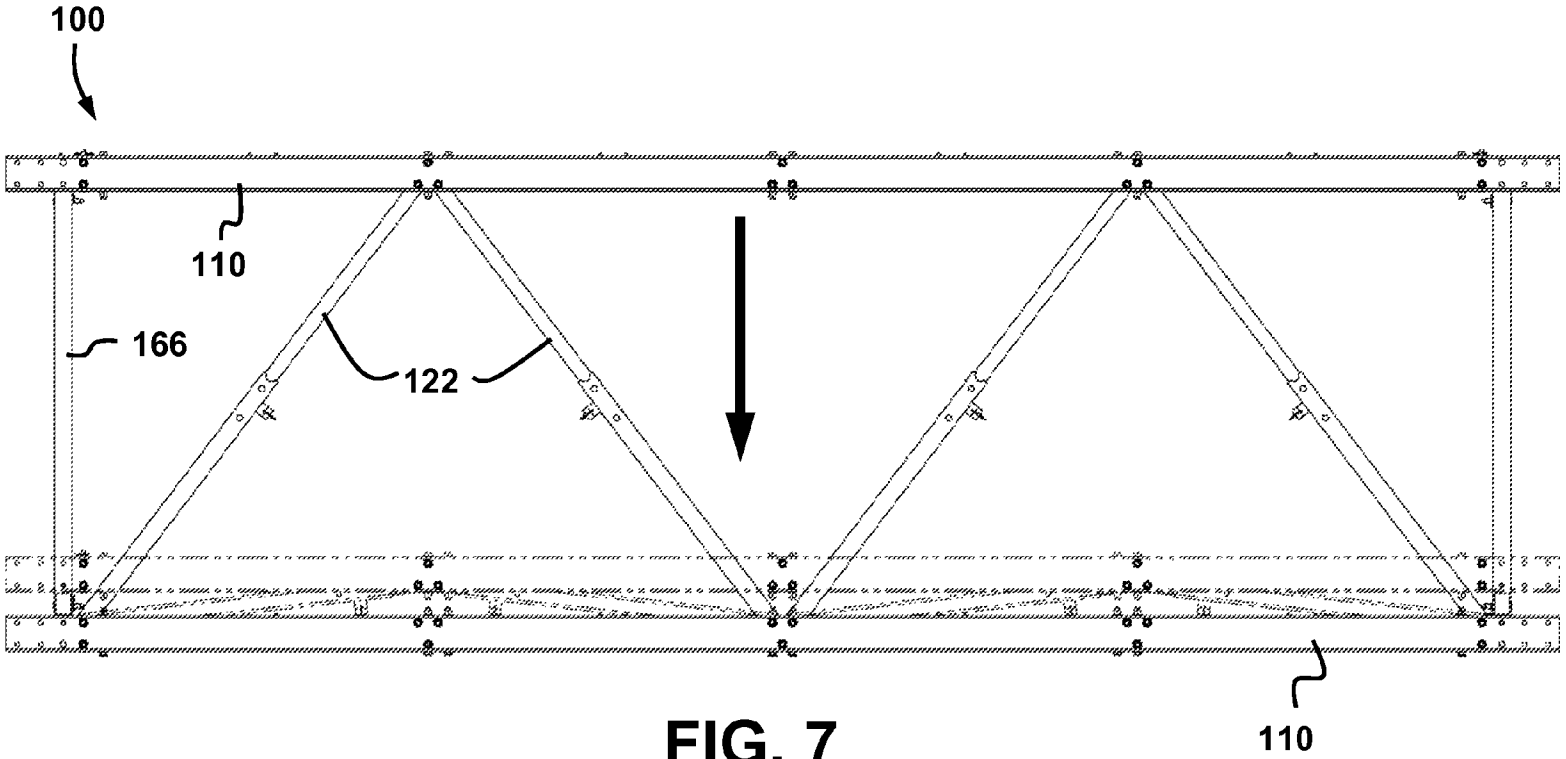
FIG. 7 is a longitudinal side view of the structural truss as in FIG. 5.
Figure 8:
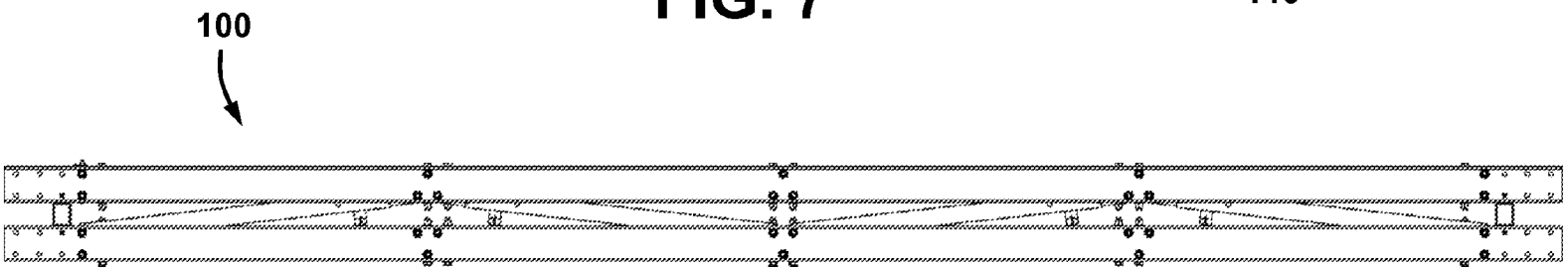
FIG. 8 is a longitudinal side view of the structural truss as in FIG. 6.

FIG. 7 is a longitudinal side view of the structural truss 100 as in FIG. 5. FIG. 8 is a longitudinal side view of the structural truss 100 as in FIG. 6.

Figure 9:
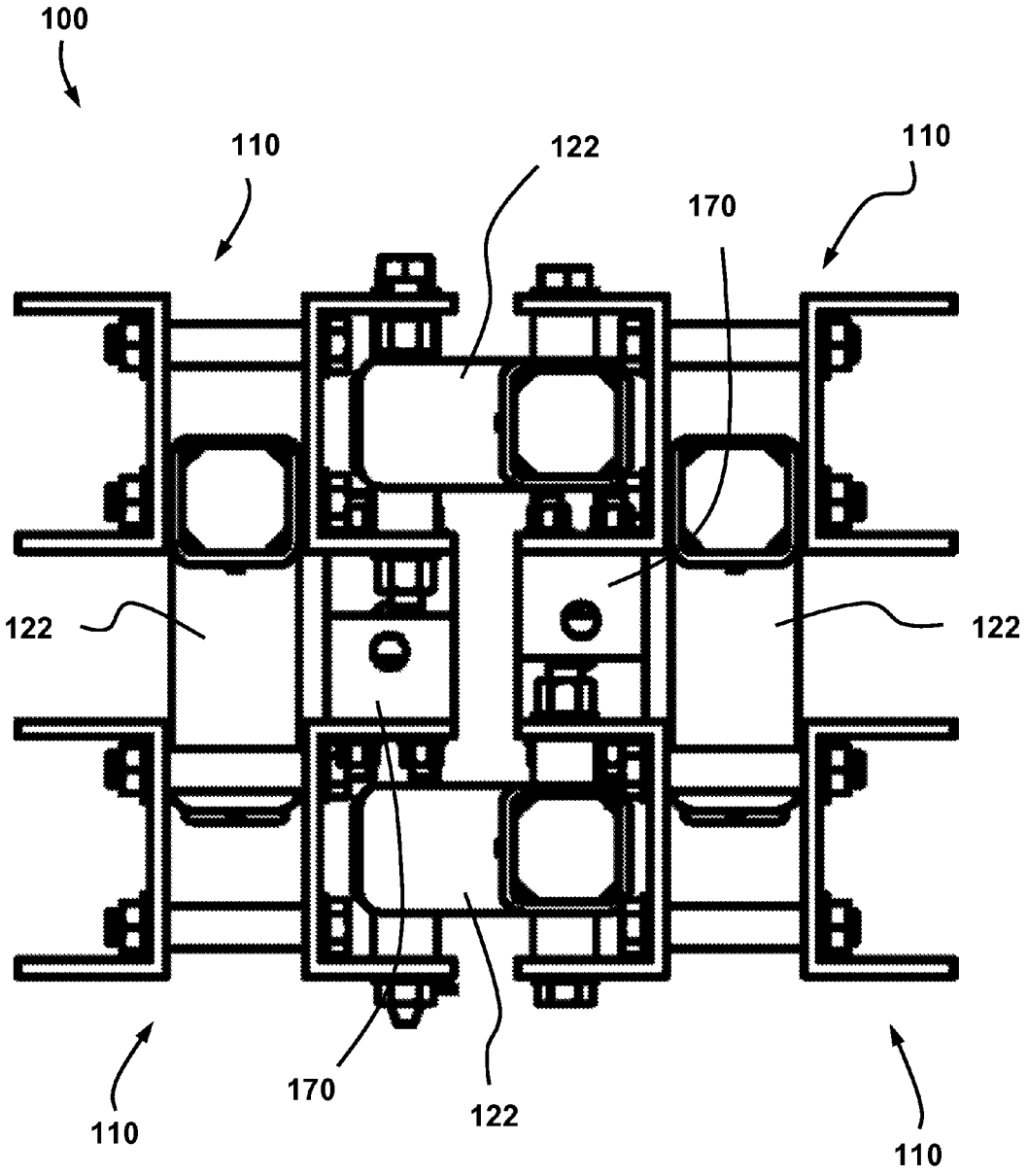
FIG. 9 is an enlarged end view of the completely folded structural truss shown in FIG. 3.

FIG. 9 is an enlarged end view of the completely folded structural truss 100 shown in FIG. 3. It shows the same parts as in FIG. 3 but at a larger scale for the sake of clarity.

Figure 10:
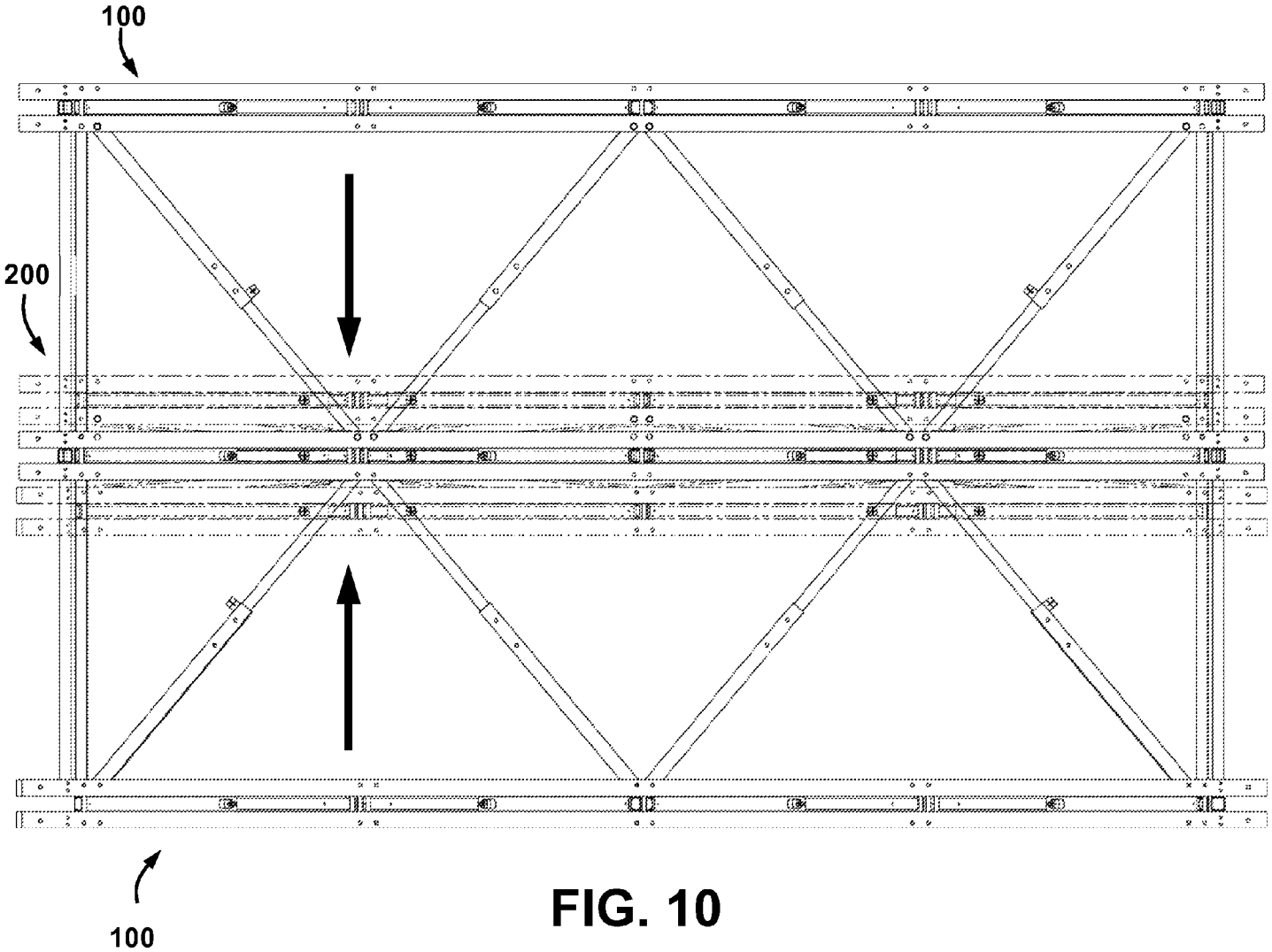
FIG. 10 is a longitudinal top view of an example of a structural truss system formed by the structural truss shown in FIG. 1 to which two additional chord beam units and three corresponding web units were added.

FIG. 10 is a longitudinal top view of an example of a structural truss system 200 formed by the structural truss 100 shown in FIG. 1 to which two additional chord beam units 110 and three corresponding web units 120 were added. These additional parts were added to the lateral side of the basic quadrilateral structural truss 100 of FIG. 1, used as a core, so as to form the structural truss system 200. The two superposed chord beam units 110 at the center of the structural truss system 200 are shared by both halves thereof. The structural truss system 200 is somewhat the equivalent of two quadrilateral structural trusses 100 disposed side-by-side in the horizontal plane but has a lesser weight and a smaller folded size.

Figure 11:
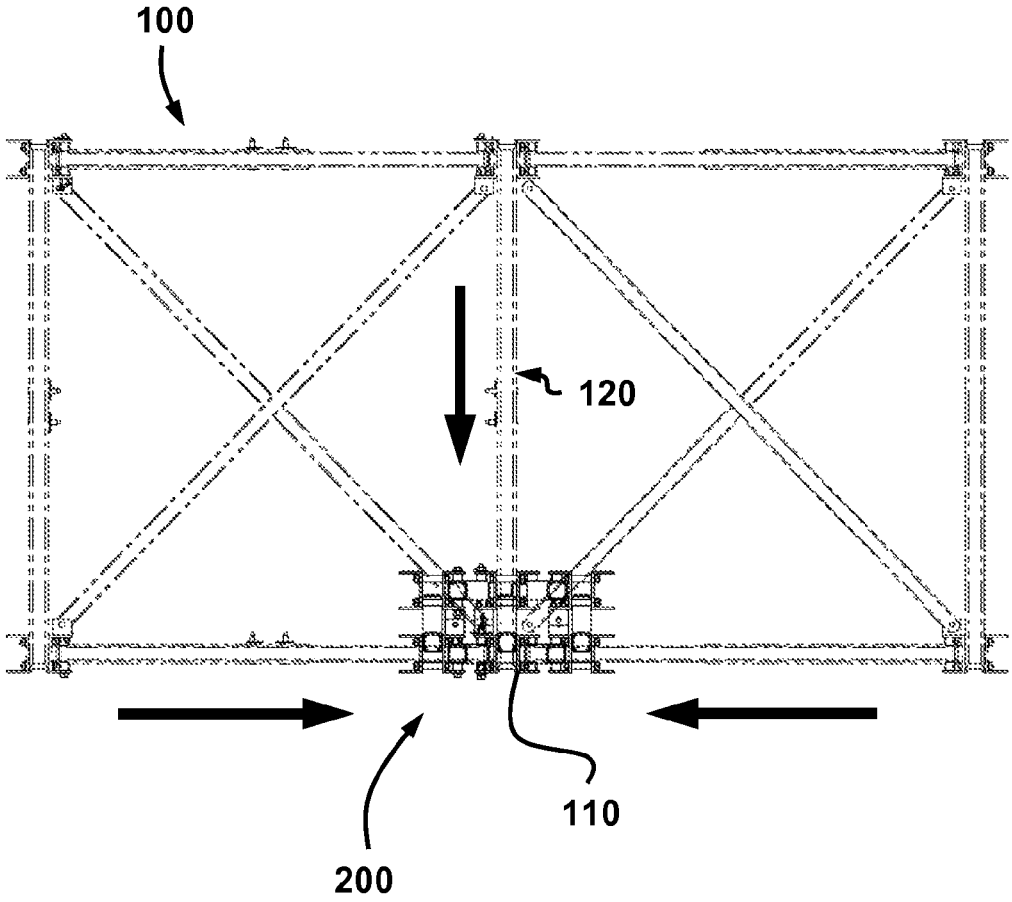
FIG. 11 is an end view of the structural truss system shown in FIG. 10.
Figure 12:
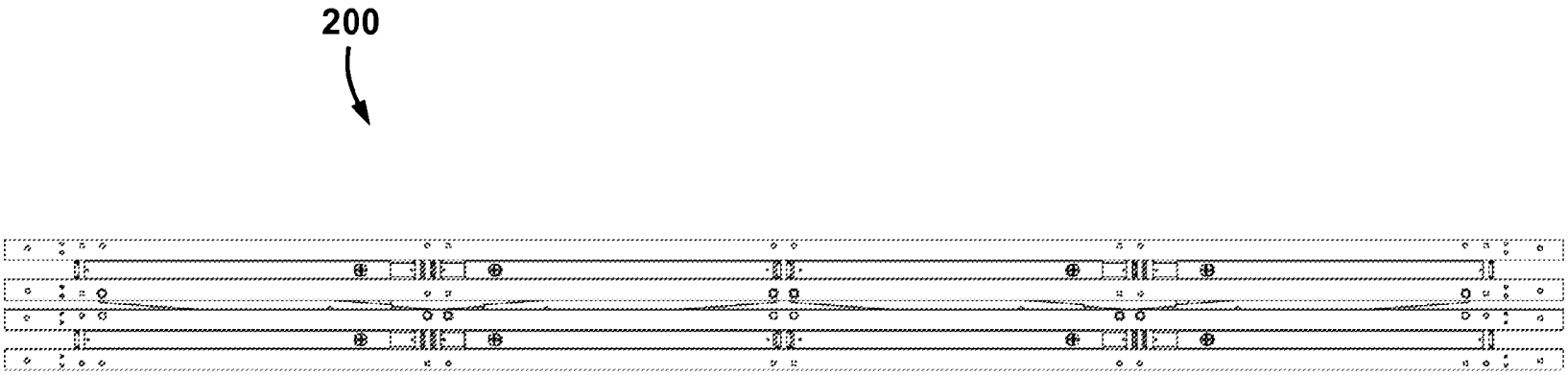
FIG. 12 is a longitudinal top view of the structural truss system shown in FIG. 10 once in its completely folded position.

FIG. 11 is an end view of the structural truss system 200 shown in FIG. 10. FIG. 12 is a longitudinal top view of the structural truss system 200 shown in FIG. 10 once in its completely folded position. The structural truss system 200 folds in the direction indicated by the arrows in FIG. 11. It unfolds in the opposite direction.

If desired, one can add more additional chord beam units 110 and a corresponding number of additional web units 120 to form a wider structural truss system 200.

Figure 13:
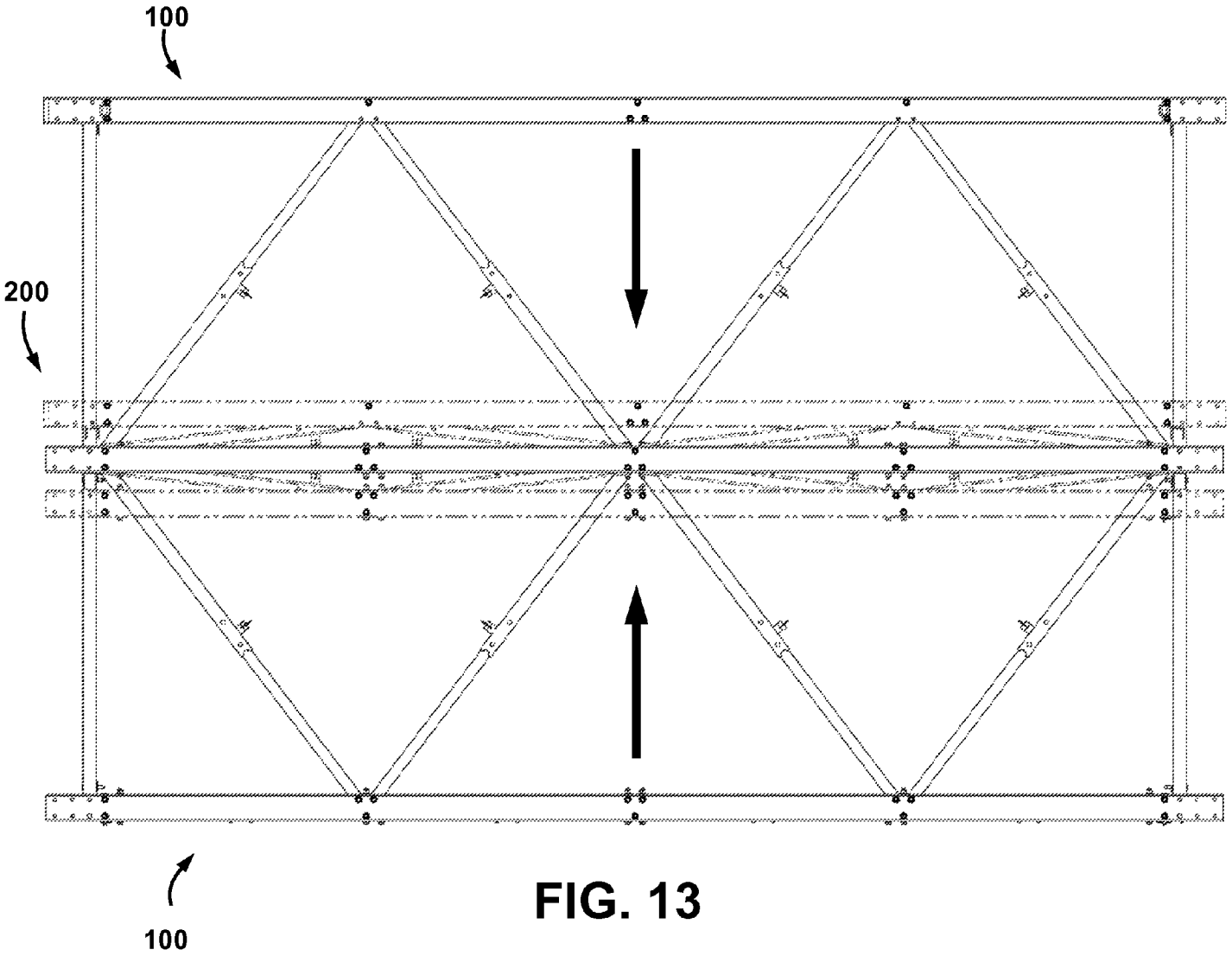
FIG. 13 is a longitudinal side view of another example of a structural truss system formed by the structural truss shown in FIG. 1 to which two additional chord beam units and three corresponding web units were added.

FIG. 13 is a longitudinal side view of another example of a structural truss system 200 formed by the structural truss 100 shown in FIG. 1 to which two additional chord beam units 110 and three corresponding web units 120 were added. In this example, the two additional chord beam units 110 and the three corresponding web units 120 are provided on the top (or bottom) side of the basic quadrilateral structural truss 100 shown in FIG. 1. The two juxtaposed chord beam units 110 at the center are shared by both halves of this structural truss system 200. The structural truss system 200 is somewhat the equivalent of two quadrilateral structural trusses 100 disposed one over the other has a lesser weight and a smaller folded size.

Figure 14:
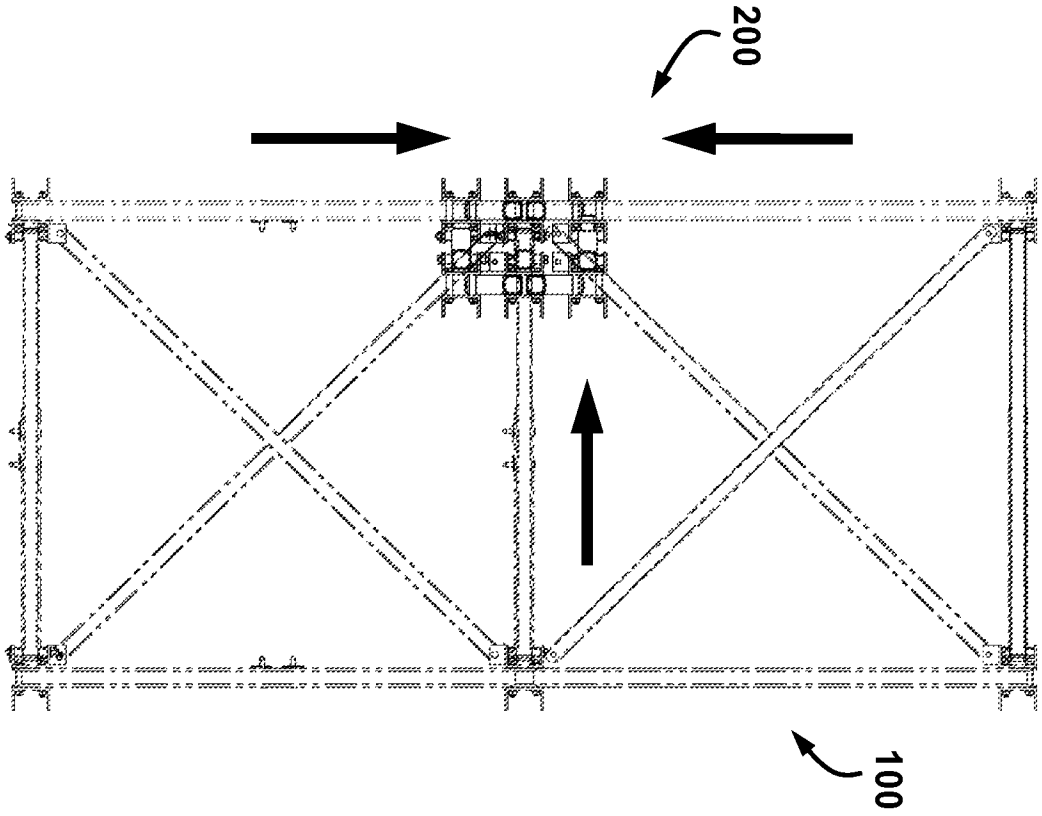
FIG. 14 is an end view of the structural truss system shown in FIG. 13.

FIG. 14 is an end view of the structural truss system 200 shown in FIG. 13. The structural truss system 200 folds in the direction depicted by the arrows.

If desired, one can add more additional chord beam units 110 and a corresponding number of additional web units 120 to the structural truss system 200 of FIGS. 13 and 14. It is also possible to combine the additional chord beam units 110 and the corresponding web units 120 of the structural truss system 200 shown in FIGS. 10 to 12, with the additional chord beam units 110 and the corresponding web units 120 of the structural truss system 200 shown in FIGS. 13 and 14.

Figure 15:
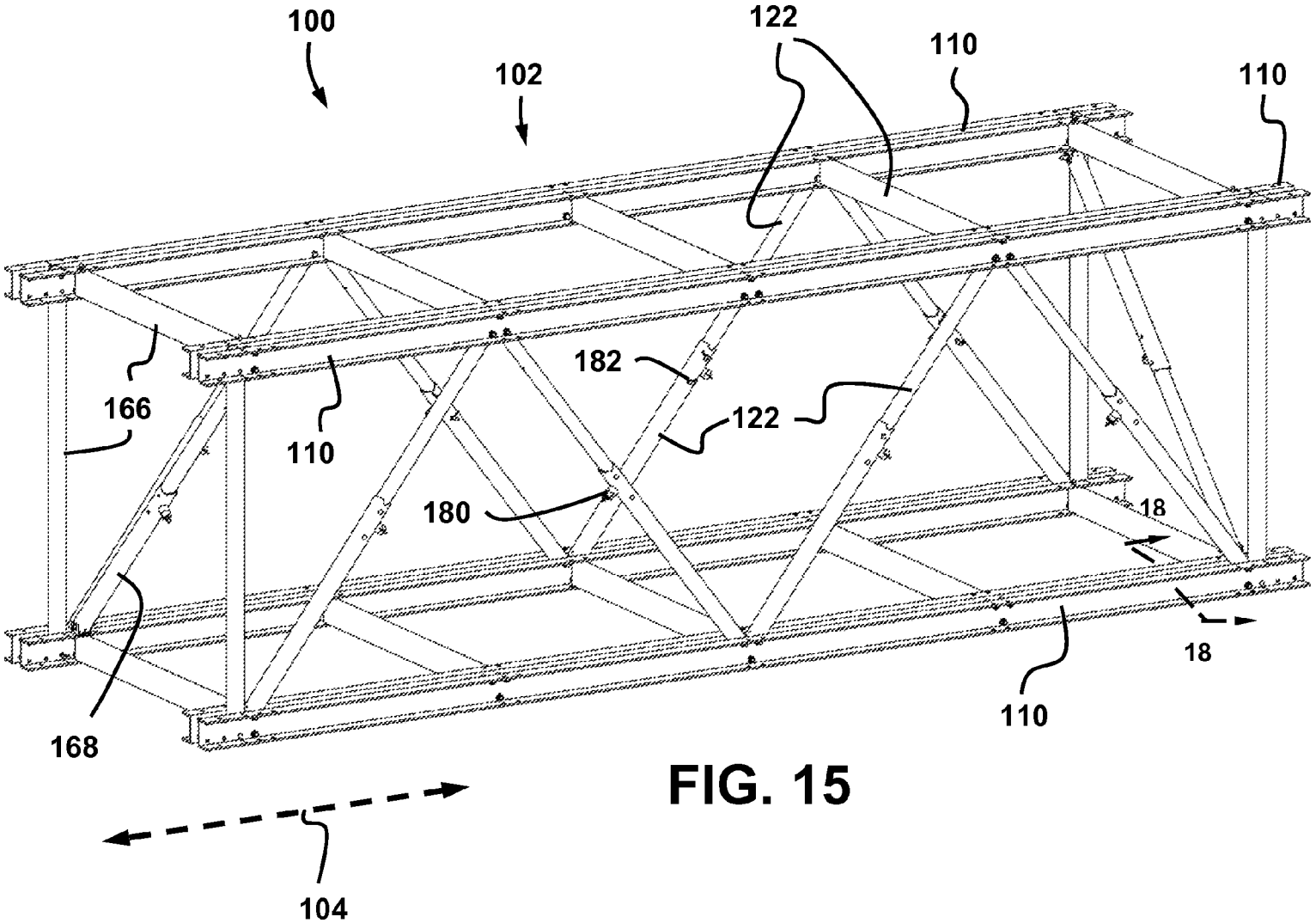
FIG. 15 is an isometric view of another example of an elongated double-fold foldable structural truss incorporating the proposed concept, the structural truss being shown in its unfolded position.
Figure 16:
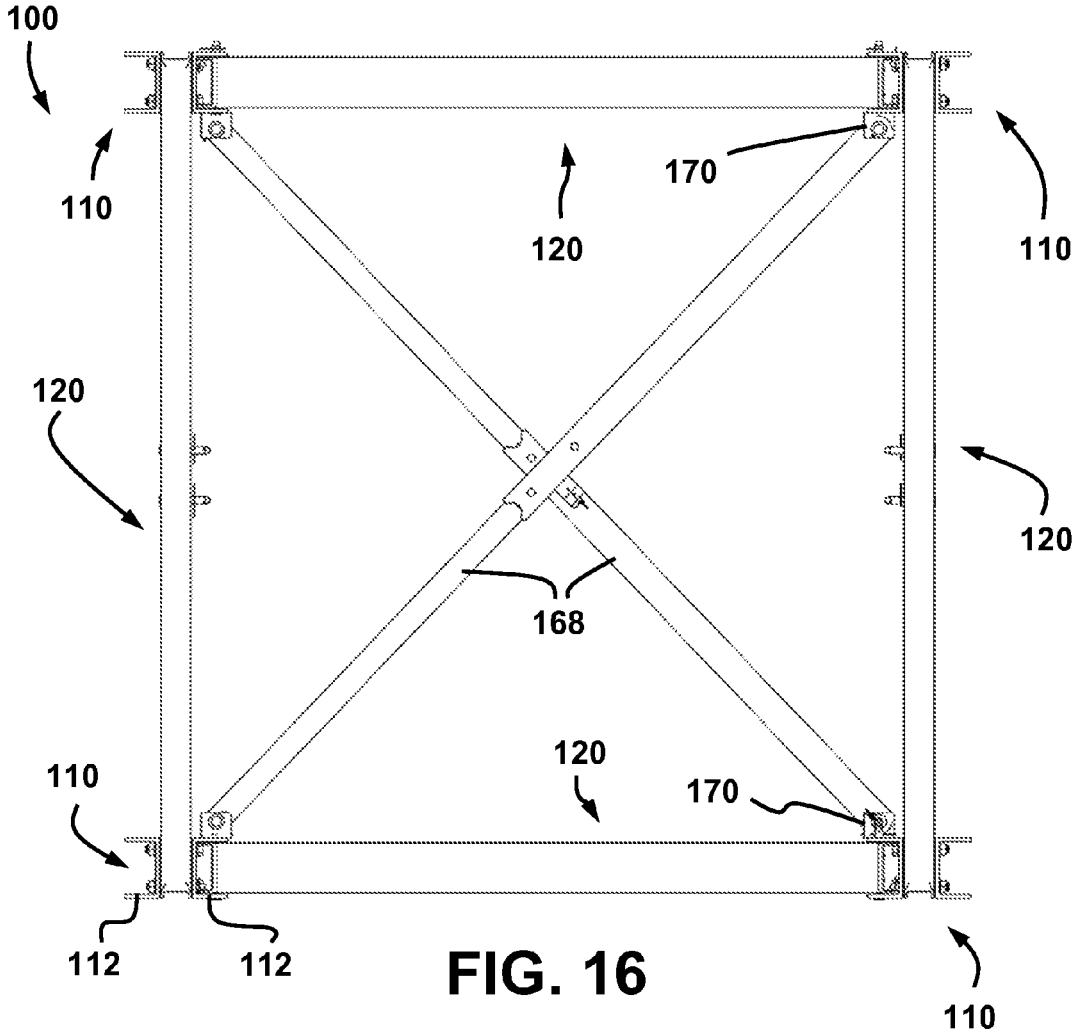
FIG. 16 is an end view of the structural truss shown in FIG. 15.

FIG. 15 is an isometric view of another example of an elongated double-fold foldable structural truss 100 incorporating the proposed concept. This structural truss 100 is shown in its unfolded position. FIG. 16 is an end view of the structural truss 100 shown in FIG. 15. In the illustrated example, the brace members 122 on the top and bottom web units 120 have a fixed length. They are thus non-telescopic. These brace members 122 are also at right angle between the corresponding chord beam units 110. The other brace members 122 are telescopic. Also, the cross brace members 168 are also telescopic. They are disposed at the diagonal and are connected to brackets 170 that are pivotally attached with pins 172 extending across the corresponding chord beam units 110. The structural truss 100 is otherwise substantially similar to the structural truss 100. Variants are possible as well.

Figure 17:
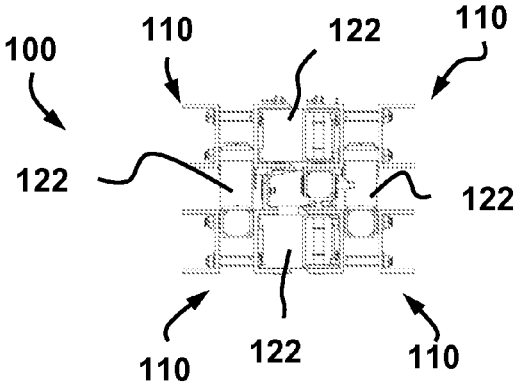
FIG. 17 is an end view of the structural truss of FIG. 15 but shown in its completely folded position.

FIG. 17 is an end view of the structural truss 100 of FIG. 15 but shown in its completely folded position.

Figure 18:
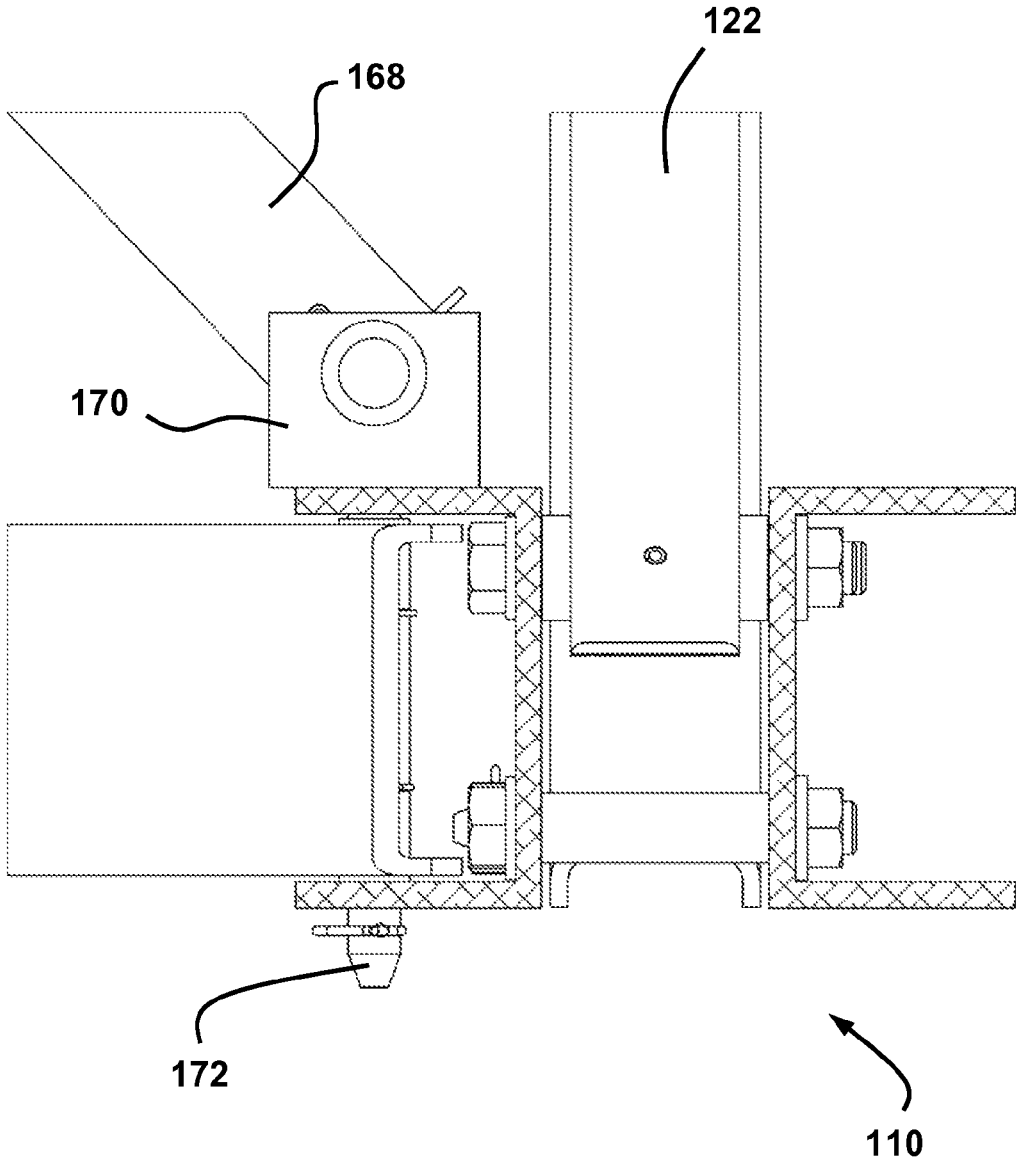
FIG. 18 is a cross-sectional view taken along line 18-18 in FIG. 15.

FIG. 18 is a cross-sectional view taken along line 18-18 in FIG. 15.

Figure 19:
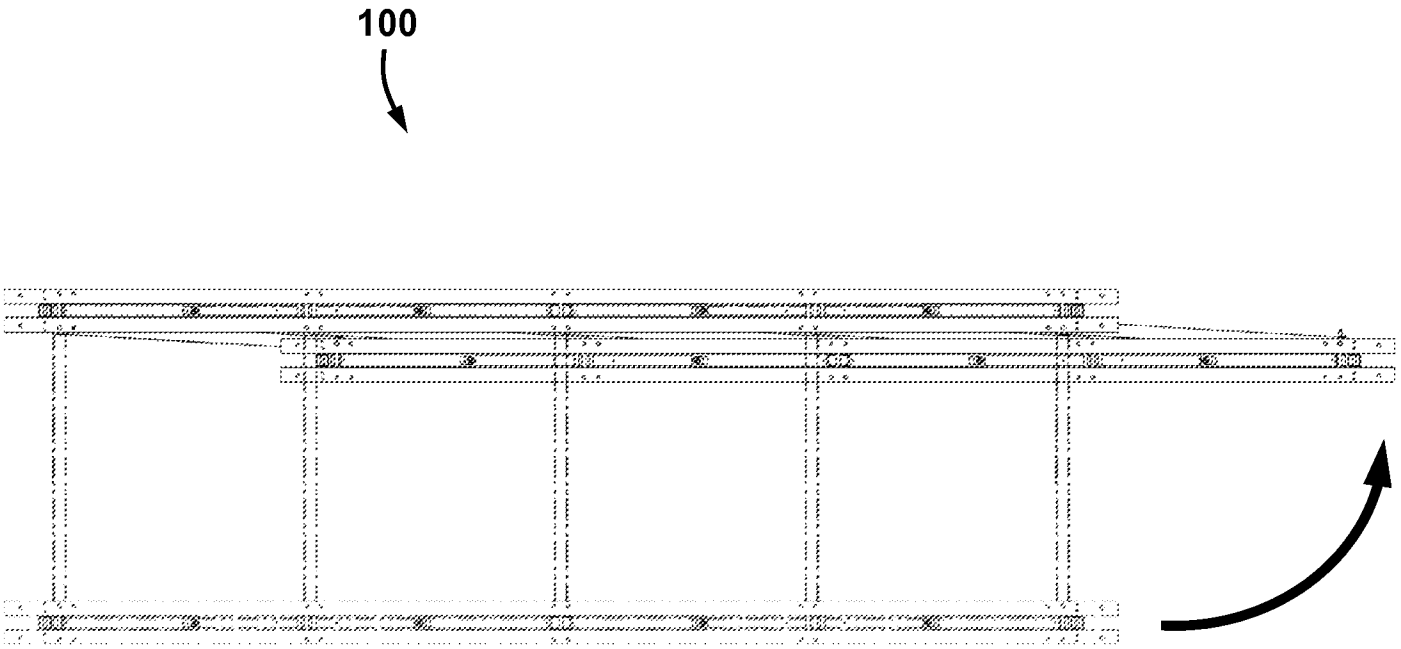
FIG. 19 is a longitudinal top view of the structural truss shown in FIG. 15 being folded.

FIG. 19 is a longitudinal top view of the structural truss 100 shown in FIG. 15 being folded. As can be seen, the brace members 122 on the horizontal move the chord beam members 110 of the other side into a longitudinally offset position when this structural truss 100 is in the folded position.

Figure 20:
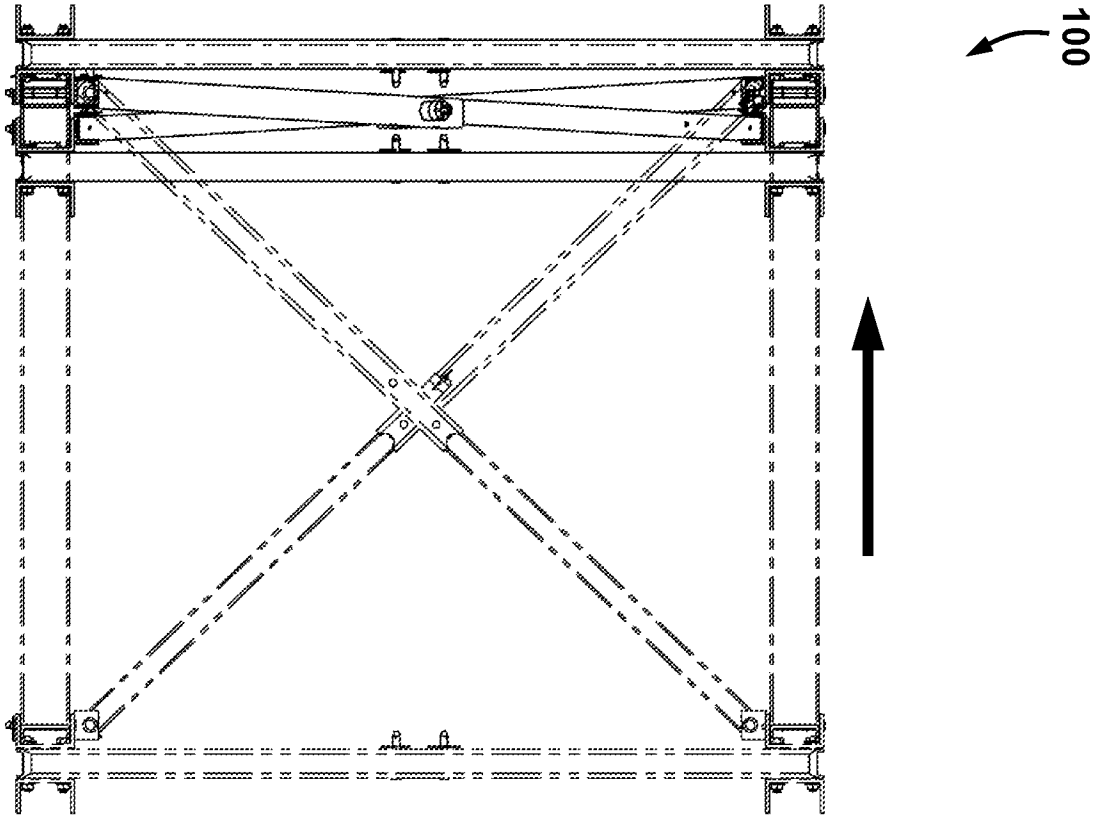
FIG. 20 is an end view of the structural truss shown in FIG. 19.
Figure 21:
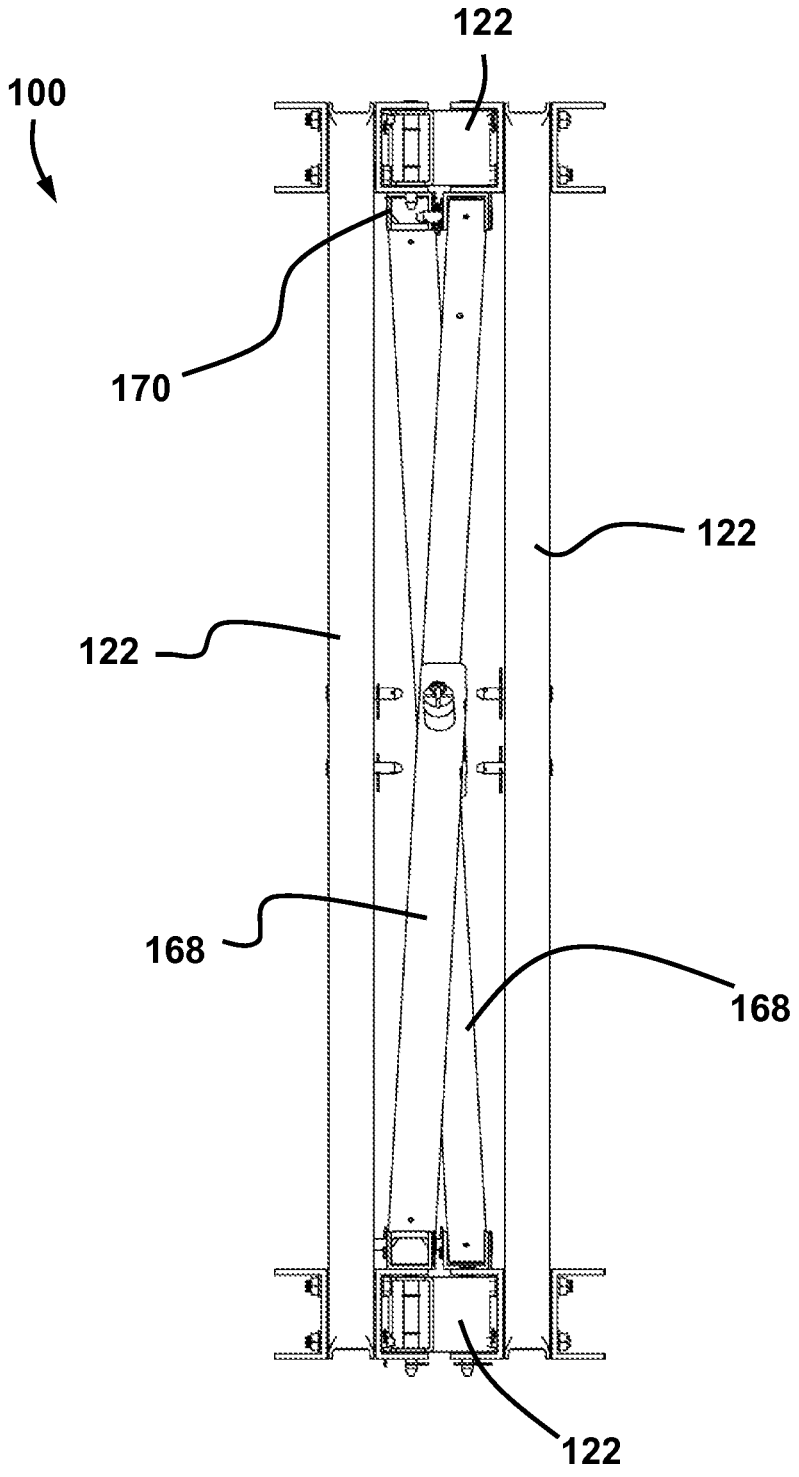
FIG. 21 is a view similar to FIG. 20, showing the resulting partially-folded structural truss.

FIG. 20 is an end view of the structural truss 100 shown in FIG. 19. FIG. 21 is a view similar to FIG. 20, showing the resulting partially-folded structural truss 100. As can be seen, the ends of the cross brace members 168 can remain attached in this folded structural truss 100 since the brackets 170 are designed to pivot around the pins 172. The cross brace members 168 are telescopic and can fold into a retracted position.

Figure 22:
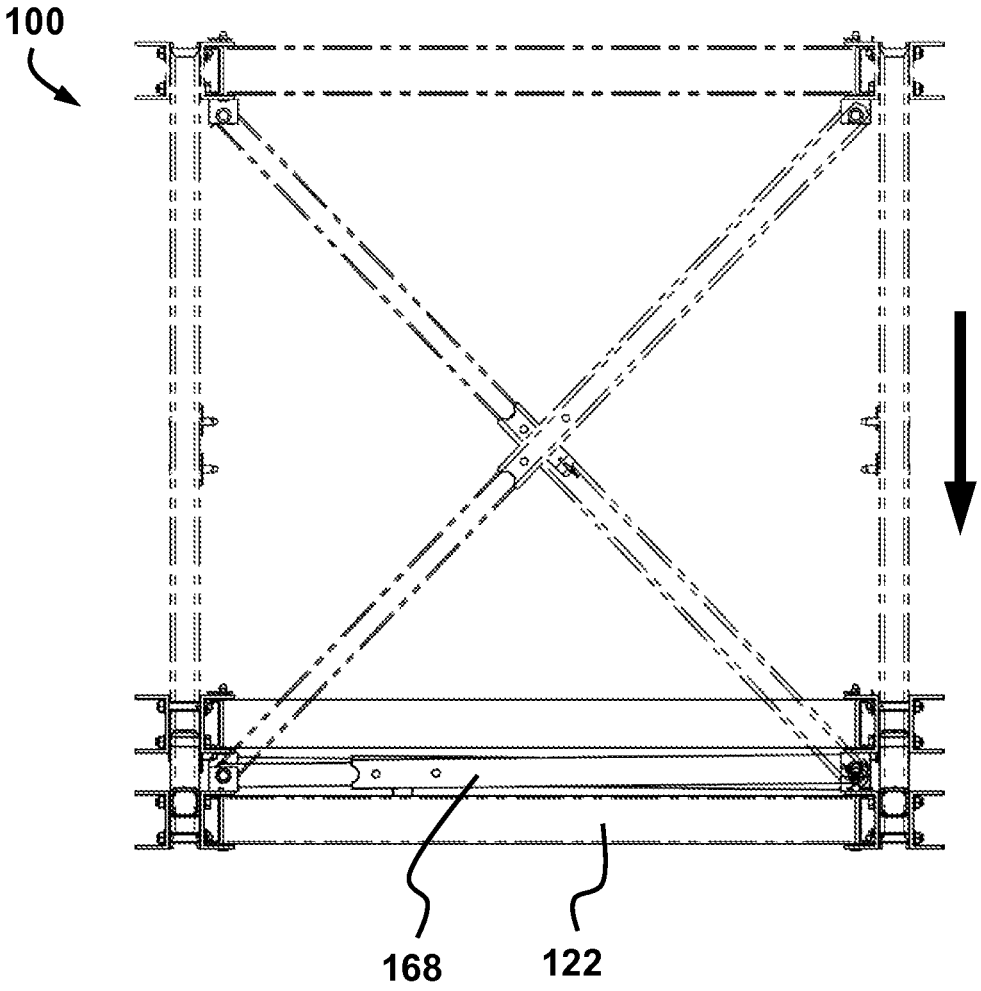
FIG. 22 is an end view of the structural truss of FIG. 15 but shown when folded first in the vertical direction.
Figure 23:
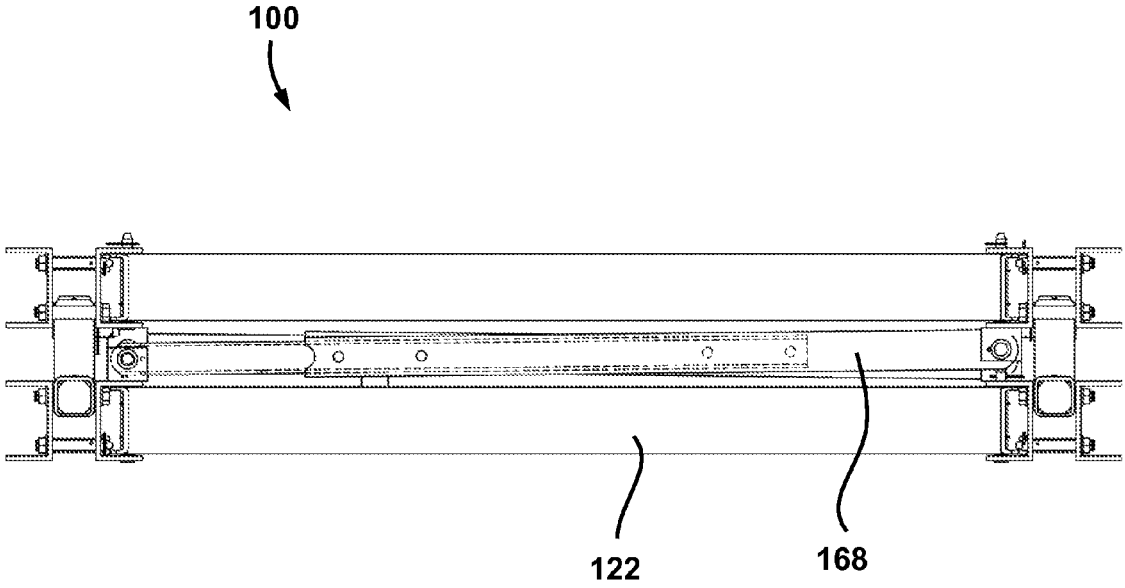
FIG. 23 is a view similar to FIG. 22, showing the structural truss once partially folded.

FIG. 22 is an end view of the structural truss 100 of FIG. 15 but shown when folded first in the vertical direction. FIG. 23 illustrates the structural truss 100 once partially folded.

Figure 24:
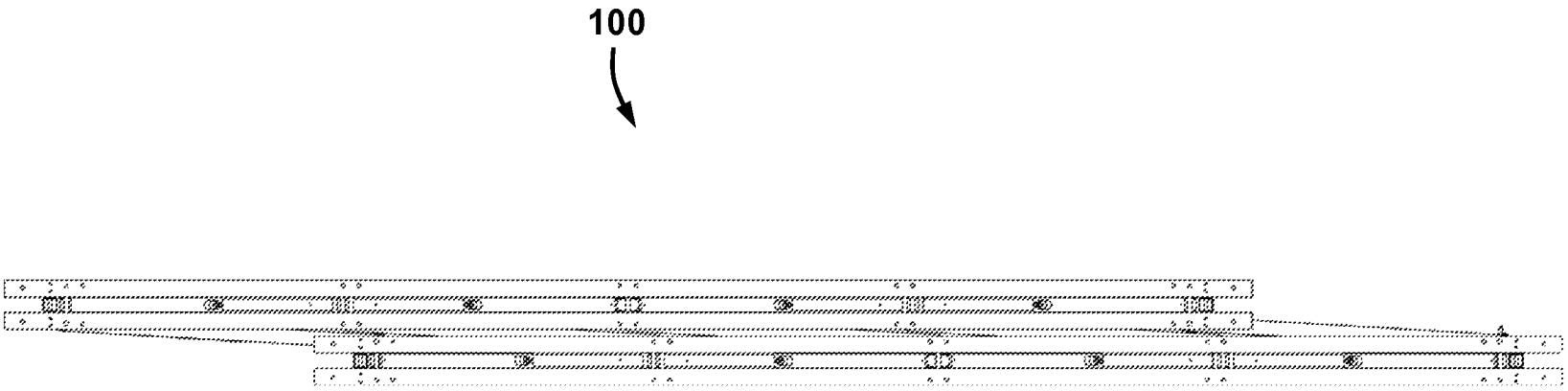
FIG. 24 is a longitudinal top view of the structural truss of FIG. 15 once completely folded.

FIG. 24 is a longitudinal top view of the structural truss 100 of FIG. 15 once completely folded.

Figure 25:
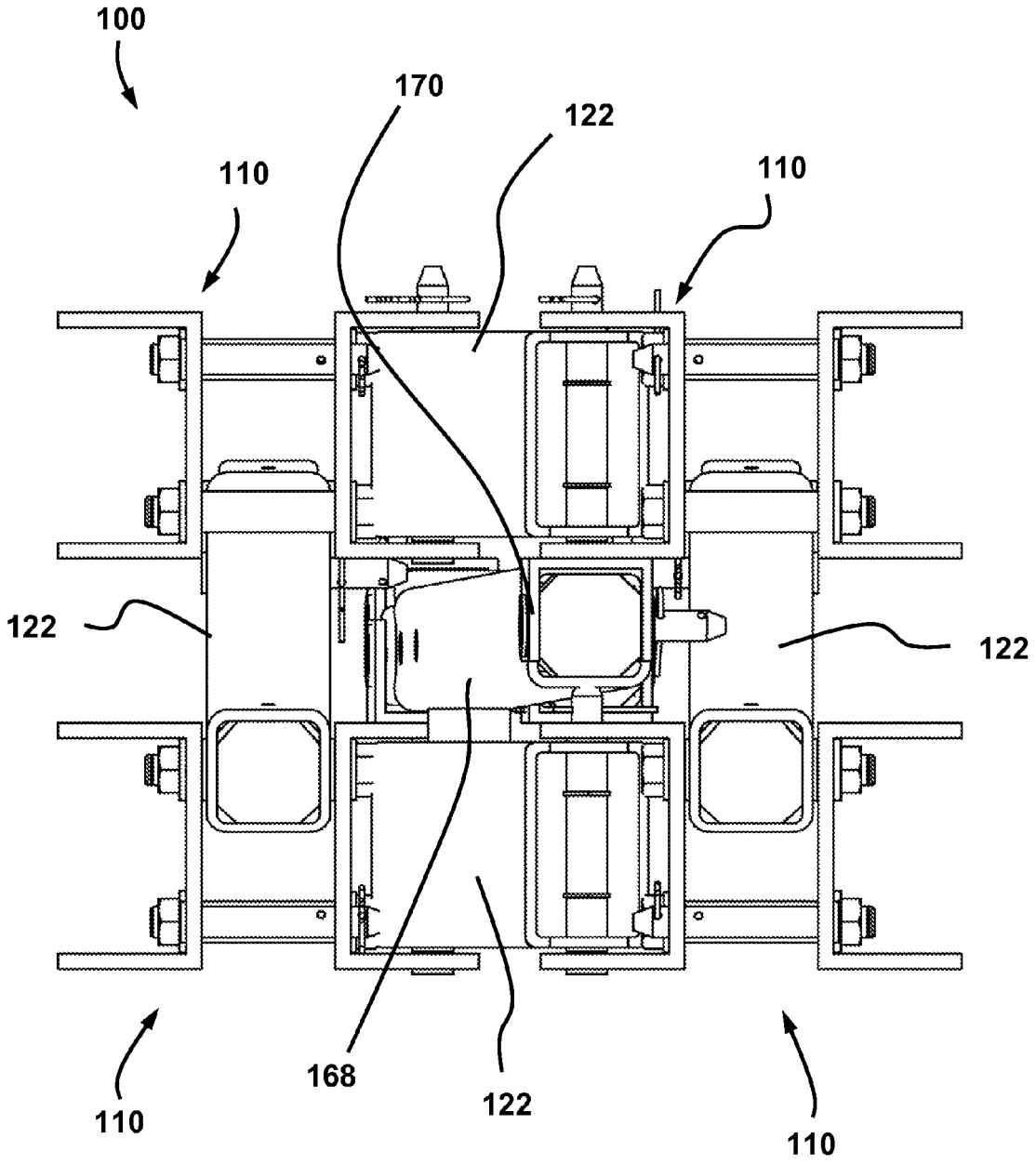
FIG. 25 is enlarged end view of the completely folded structural truss shown in FIG. 17.

FIG. 25 is enlarged end view of the completely folded structural truss shown in FIG. 17.

Figure 26:
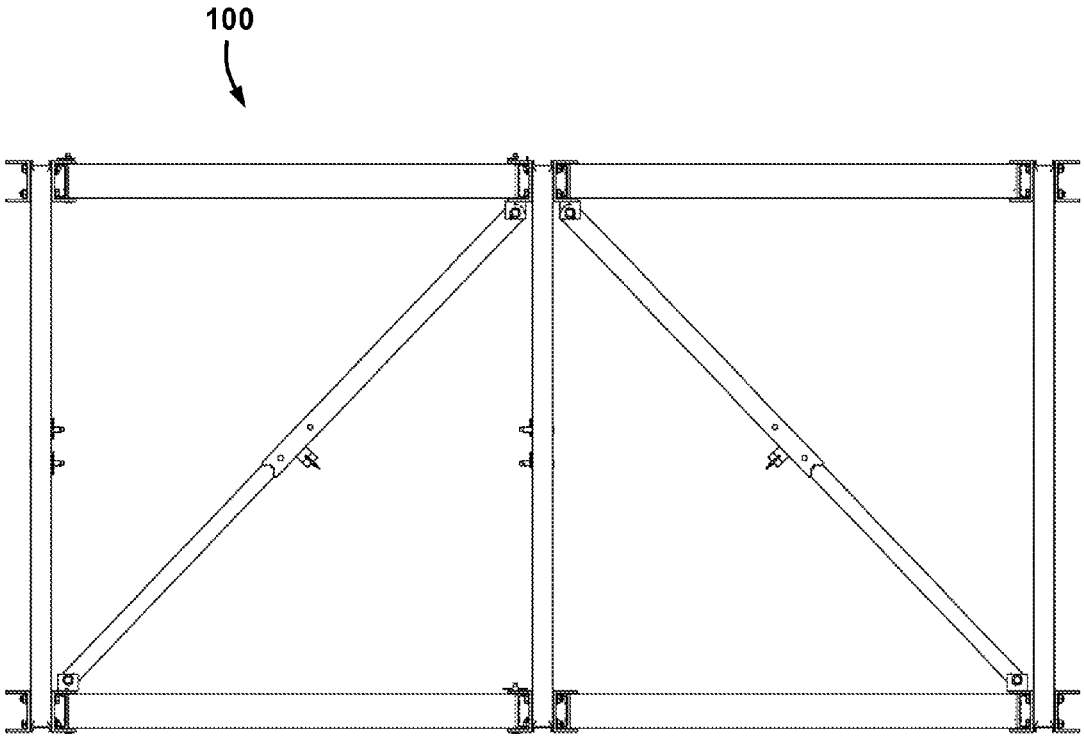
FIG. 26 is an end view of another example of a structural truss system formed by the structural truss shown in FIG. 15 to which two additional chord beam units and three corresponding web units were added.
Figure 27:
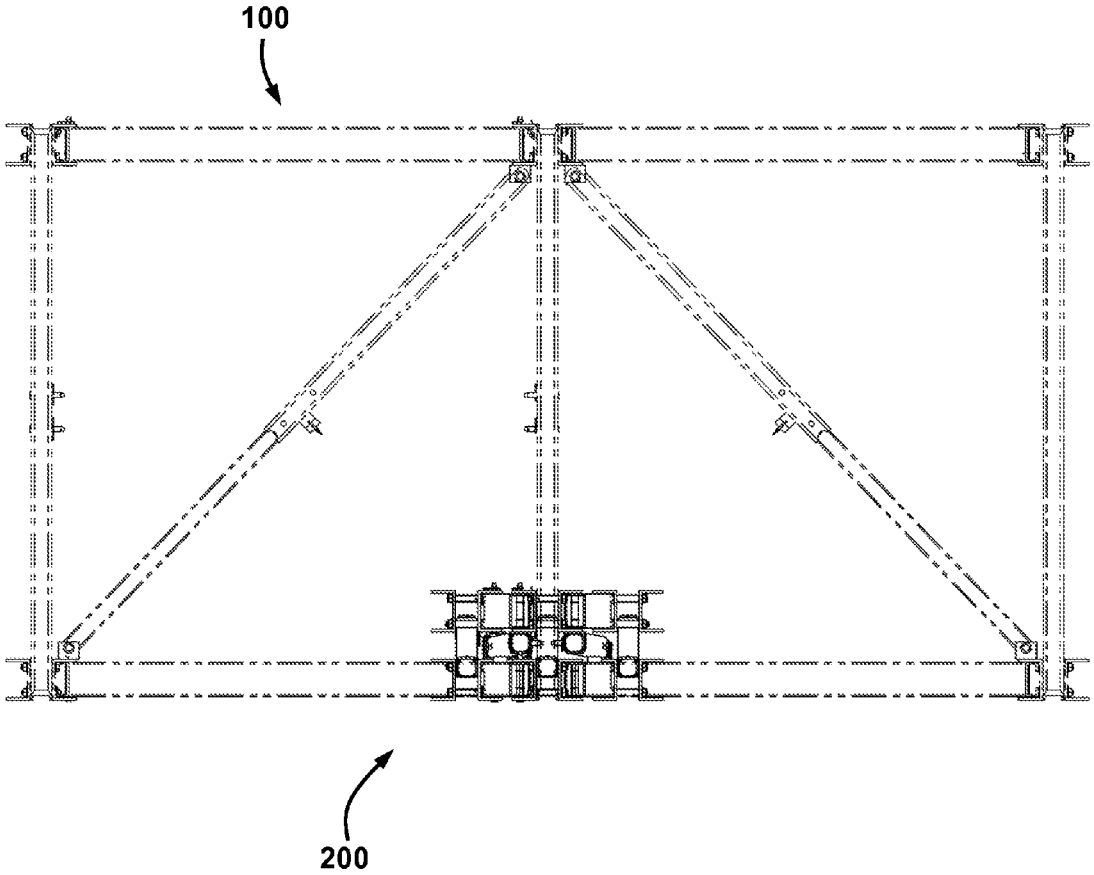
FIG. 27 is a view similar to FIG. 26, showing the structural truss system of FIG. 26 being folded.
Figure 28:
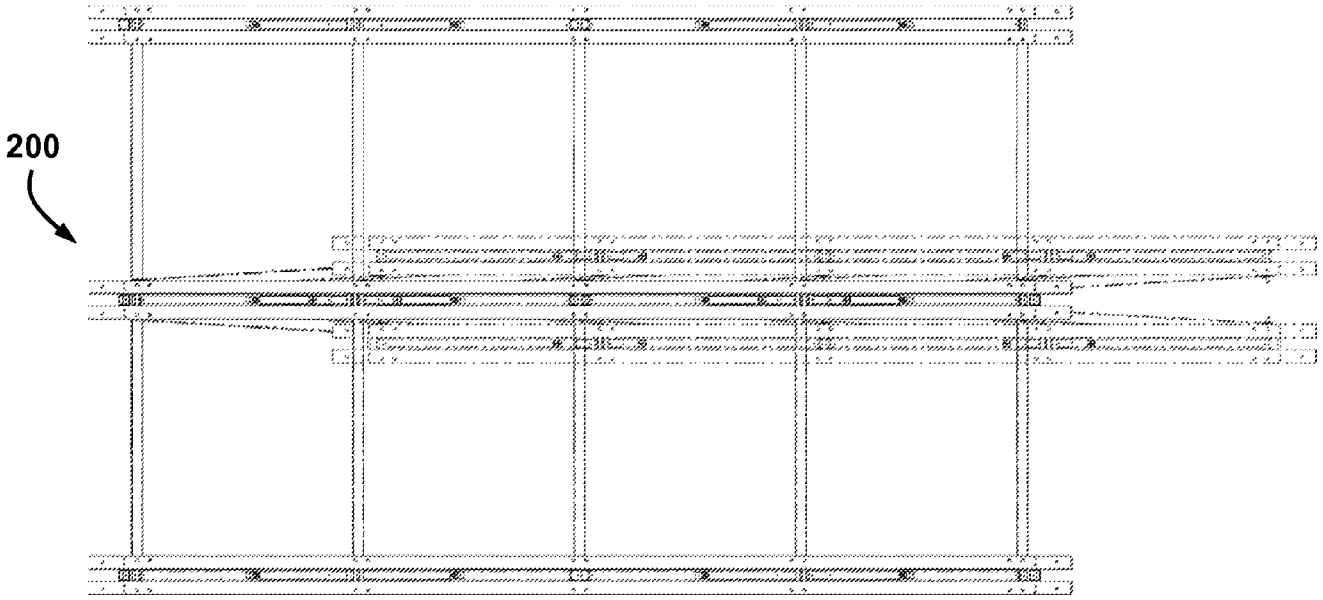
FIG. 28 is a longitudinal top view of the structural truss system shown in FIG. 26 being folded.
Figure 29:
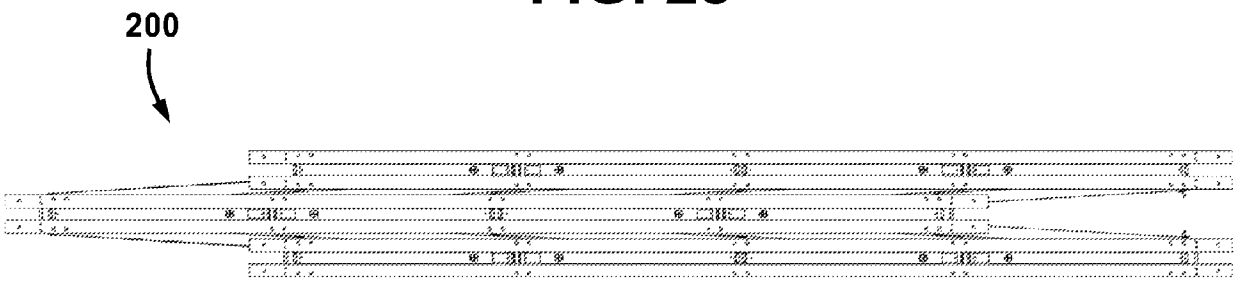
FIG. 29 is a longitudinal top view of the structural truss system shown in FIG. 26 once completely folded.
Figure 30:
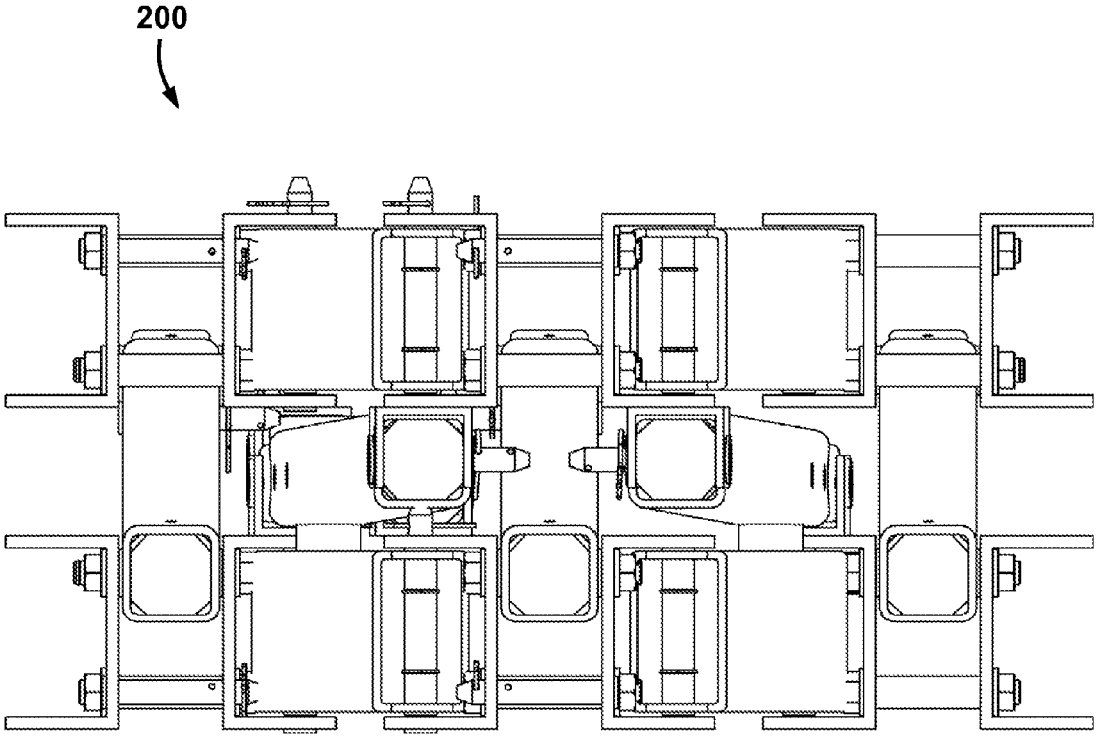
FIG. 30 is an end view of the completely folded structural truss system shown in FIG. 29.

FIG. 26 is an end view of another example of a structural truss system 200 formed by the structural truss 100 shown in FIG. 15 to which two additional chord beam units 110 and three corresponding web units 120 were added as in FIG. 10. FIG. 27 shows the truss system 200 of FIG. 26 being folded. FIG. 28 is a longitudinal top view thereof. FIG. 29 is a longitudinal top view of the structural truss system 200 of FIG. 26 once completely folded. FIG. 30 is an end view of this completely folded structural truss system 200.

As can be appreciated, the foldable structural truss 100 is very compact in its folded position. The overall cross section area in the folded position is many times smaller than that the overall cross section area in the unfolded position. Moreover, the foldable structural truss 100 can still be manufactured using relatively simple and standard parts so as to minimize the manufacturing costs. The foldable structural truss 100 can be opened and closed relatively easily and quickly since many of the parts are preassembled, thereby minimizing the assembly time and labor costs.

The foldable structural truss 100 can be very useful in many applications. An example of application is a mobile performance stage for music concerts or other kinds of events. Other possible applications include roadways, gangways, bridges, cranes, roadways, catwalks, towers, masts, etc. Many other applications are possible as well.

The present detailed description and the appended figures are meant to be exemplary only, and a skilled person will recognize that many changes can be made while still remaining within the proposed concept.

LIST OF REFERENCE NUMERALS

100 foldable structural truss
102 quadrilateral framework
104 longitudinal direction
110 chord beam unit
112 beam
114 beam holder
120 web unit
122 brace member
130 first pivot joint
132 second pivot joint
134 open channel (center)
136 open channel (side)
140 first pivot axis
142 second pivot axis
150 cylindrical spacer
152 bolt
160 bushing
162 bushing
164 bolt
166 additional brace member
168 cross brace member
170 bracket
172 pin
180 button
182 fastener
200 structural truss system

What is claimed is:

1. An elongated double-fold foldable structural truss having a quadrilateral framework extending along a longitudinal direction, the structural truss being movable between a folded position and an unfolded position, and including:

four chord beam units disposed parallel to one another, each chord beam unit being located at a corresponding corner of the quadrilateral framework and having four sides, two of the sides being inner sides and two of the sides being outer sides, each inner side facing a corresponding one of the inner sides of another one of the chord beam units of the structural truss, each chord beam unit including:

two spaced-apart and juxtaposed beams running parallel to one another, the beams defining between them a first open channel extending substantially along an entire length of the structural truss, the first open channel being opened on one of the inner sides of the chord beam unit, the chord beam unit having a second open channel on the other one the inner sides of the chord beam unit, the second open channel extending substantially along the entire length of the structural truss;

a plurality of first pivot joints extending transversally in-between the two spaced-apart beams and across the first open channel, the first pivot joints having first pivot axes that are parallel to one another and that are perpendicular to the longitudinal direction; and a plurality of second pivot joints extending perpendicularly across the second open channel, the second pivot joints having second pivot axes that are parallel to one another, that are perpendicular to the longitudinal direction and that are perpendicular to the first pivot axes of the chord beam unit; and four web units, each including a plurality of brace members interconnecting two corresponding ones of the chord beam units, the brace members of two of the web units having opposite ends that are pivotally connected to corresponding ones of the first pivot joints and the braces members of two of the web units having opposite ends that are pivotally connected to corresponding ones of the second pivot joints, the brace members of at least two of the web units being telescopic, each telescopic brace member including two sections in telescopic engagement with one another and being movable between a retracted position and an extended position, the telescopic brace members being all in their extended position when the structural truss is in its unfolded position and being all in their retracted position when the structural truss is in its folded position, all brace members extending at least partially inside a corresponding one of the open channels when the structural truss is in its folded position.

2. The foldable structural truss as defined in claim 1, wherein the brace members of all four chord beam units are telescopic.

3. The foldable structural truss as defined in claim 1, wherein the brace members of two of the web units have a fixed length, the fixed length being the same regardless if the structural truss is in its folded position or in its unfolded position, the chord beam units to which the fixed-length brace members are pivotally connected being mutually offset when the structural truss is in its folded position.

4. The foldable structural truss as defined in claim 1, wherein the corresponding sections of each telescopic brace member are rigidly secured to one another, when in their extended position, using at least one removable fastener positioned substantially radially across corresponding registered openings provided through the sections.

5. The foldable structural truss as defined in claim 4, wherein the corresponding sections of each telescopic brace member include a self-locking mechanism between the sections to temporarily lock them in position with reference to one another, when in their extended position, the self-locking mechanism having a spring-biased button.

6. The foldable structural truss as defined in claim 1, wherein the telescopic brace members of at least some of the web units have more than one possible position corresponding to the extended position.

7. The foldable structural truss as defined in claim 1, wherein the four web units are identical to one another.

8. The foldable structural truss as defined in claim 1, wherein the beams of each chord beam unit are C-shaped beams, the two beams being oppositely-juxtaposed.

9. The foldable structural truss as defined in claim 1, wherein the beams of each chord beam unit are rigidly interconnected using a plurality of longitudinally-spaced sets of beam holders.

10. The foldable structural truss as defined in claim 1, wherein the braces members of all web units remain pivotally connected to corresponding ones of the pivot joints regardless if the structural truss is in its folded position or in its unfolded position.

11. The foldable structural truss as defined in claim 1, further including at least one set of additional brace members extending at right angle between corresponding ones of the chord beam units.

12. The foldable structural truss as defined in claim 11, wherein the at least one set of additional brace members is located at a corresponding end of the structural truss.

13. The foldable structural truss as defined in claim 1, further including at least one cross brace members extending diagonally across two diametrically-opposite ones of the chord beam units.

14. The foldable structural truss as defined in claim 13, wherein the at least one cross brace members is located at a corresponding end of the structural truss.

15. The foldable structural truss as defined in claim 1, wherein the telescopic brace members are obliquely disposed with reference to the longitudinal direction.

16. A structural truss system including:

the foldable structural truss as defined in claim 1;

at least two additional chord beam units; and at least three additional web units, one of the additional web units having brace members with opposite ends that are pivotally connected to corresponding ones of the first pivot joints located on the additional chord beam units, two of the additional web units having brace members with opposite ends that are pivotally connected to corresponding ones of the second pivot joints, which second pivot joints are located on the two additional chord beam units and on the chord beam units of the foldable structural truss.

17. A structural truss system including:

the foldable structural truss as defined in claim 1;

at least two additional chord beam units; and at least three additional web units, one of the additional web units having brace members with opposite ends that are pivotally connected to corresponding ones of the second pivot joints located on the additional chord beam units, two of the additional web units having brace members with opposite ends that are pivotally connected to corresponding ones of the first pivot joints, which first pivot joints are located on the two additional chord beam units and on the chord beam units of the foldable structural truss.

18. The foldable structural truss as defined in claim 1, wherein the corresponding sections of each telescopic brace member are rigidly secured to one another, when in their extended position, using at least two removable fasteners positioned substantially radially across corresponding registered openings provided through the sections.

* * * * *